US008723900B2

(12) United States Patent
Akimoto et al.

(10) Patent No.: US 8,723,900 B2
(45) Date of Patent: May 13, 2014

(54) DISPLAY DEVICE

(75) Inventors: Hajime Akimoto, Kokubunji (JP); Kenta Kajiyama, Yotsukaido (JP)

(73) Assignee: Pixtronix, Inc., San Diego, CA (US)

( * ) Notice: Subject to any disclaimer, the term of this patent is extended or adjusted under 35 U.S.C. 154(b) by 163 days.

(21) Appl. No.: 13/470,436

(22) Filed: May 14, 2012

(65) Prior Publication Data

US 2012/0293572 A1 Nov. 22, 2012

(30) Foreign Application Priority Data

May 16, 2011 (JP) ..... 2011-109737

(51) Int. Cl.
*G09G 5/10* (2006.01)
*G09G 3/36* (2006.01)

(52) U.S. Cl.
USPC ..... 345/691; 345/88

(58) Field of Classification Search
USPC ..... 345/88, 102, 213, 173, 178, 589, 690, 345/691
See application file for complete search history.

(56) References Cited

U.S. PATENT DOCUMENTS

| | | | | |
|---|---|---|---|---|
| 7,304,785 | B2 | 12/2007 | Hagood, IV et al. | |
| 7,460,290 | B2 | 12/2008 | Hagood, IV et al. | |
| 2005/0248518 | A1 | 11/2005 | Yamasaki et al. | |
| 2006/0028424 | A1 | 2/2006 | Wu et al. | |
| 2007/0064008 | A1 | 3/2007 | Childers | |
| 2007/0176943 | A1 | 8/2007 | Cho | |
| 2007/0229444 | A1 | 10/2007 | Liu et al. | |
| 2009/0066620 | A1 | 3/2009 | Russell et al. | |
| 2010/0039367 | A1 | 2/2010 | Tai et al. | |
| 2010/0045707 | A1 * | 2/2010 | Huang et al. | 345/690 |
| 2010/0295865 | A1 * | 11/2010 | Wu et al. | 345/589 |

FOREIGN PATENT DOCUMENTS

| | | |
|---|---|---|
| JP | 8-248381 | 9/1996 |
| JP | 2002-223453 | 8/2002 |
| JP | 2006085156 A | 3/2006 |
| JP | 2007-206698 | 8/2007 |
| JP | 2008-165126 | 7/2008 |
| JP | 2008165048 A | 7/2008 |
| JP | 2008-197668 | 8/2008 |

OTHER PUBLICATIONS

European Search Report—EP12168087—Search Authority—Munich—Oct. 29, 2012.

* cited by examiner

*Primary Examiner* — Michael Faragalla
(74) *Attorney, Agent, or Firm* — Edward A. Gordon; Foley & Lardner LLP

(57) ABSTRACT

A display device includes: a light emission control part which allows a light source to emit the light having one of the plural different main wavelengths in each of plural sub frames; a display panel which controls the transmission of light in each pixel; and a display control part which controls the display panel corresponding to a gray level value with respect to the each pixel, wherein the light emitting control part performs the light emission of light having a first main wavelength in a first sub frame in accordance with a light emission amount weighted based on a time for calculation including a first interval which is a interval between the first sub frame where the first main wavelength is emitted and a second sub frame where the first main wavelength is emitted after the first sub frame.

18 Claims, 24 Drawing Sheets

R G R B G R B G R B

DISPLAY DEVICE

CROSS-REFERENCE TO RELATED APPLICATION

The present application claims priority from Japanese application JP2011-109737 filed on May 16, 2011, the content of which is hereby incorporated by reference into this application.

BACKGROUND OF THE INVENTION

1. Field of the Invention

The present invention relates to a display device.

2. Description of the Related Art

In a liquid crystal display, a color image is displayed in such a manner that a liquid crystal shutter is provided to each pixel, a color filter is provided to each pixel, and light irradiated from a white-color backlight light source arranged behind the pixel is allowed to selectively pass through the liquid crystal shutter and the color filter. However, the liquid crystal display has a drawback that a fine working process is necessary for acquiring high definition. This is because it is necessary to provide three pixels corresponding to three colors of R (red), G (green) and B (blue) of a color filter for every pixel to realize a color image. In a single plate color projector or the like, it is unnecessary to provide such three pixels. That is, the single plate color projector or the like adopts a so-called field sequential display method where irradiation lights of three colors of R, G, B are sequentially generated using a color filter rotary disc, and the irradiation lights are modulated by pixels using liquid crystal, an MEMS (Micro Electro Mechanical System) shutter or the like thus sequentially generating an image of three colors.

However, it has been known that this field sequential display method has a drawback referred to as color decomposition where three colors of R, G and B are visually recognized in a decomposed manner when a moving image is displayed. Although the color decomposition is also expressed as color break up, color splitting or the like, the expression "color decomposition" is used throughout this specification.

With respect to a means for overcoming this color decomposition, a first prior art is explained in conjunction with FIG. 32. FIG. 32 is a schematic view of a moving image display in the first prior art, wherein an X coordinate on a screen is taken on an axis of abscissas and time is taken on an axis of ordinates, and the manner that a white image displayed in accordance with a field sequential method moves in the X direction is expressed. In this prior art, to obviate the color decomposition which generates particular coloring in front of and behind the white moving image, lights of R, G, B are emitted in different order for every 1 frame. This prior art is described in detail in Japanese Patent Application Publication JP 8-248381 A and JP 2002-223453 A.

FIG. 34 shows a timing chart of light emitting brightness of a light source used in a field sequential method of a second prior art where time is taken on an axis of abscissas and brightness is taken on an axis of ordinates. In this prior art, to increase a speed of lighting frequency of each color thus obviating color decomposition, a light of additional color is further emitted for every 1 frame. In FIG. 34, a light emitting cycle completes one turn for every three frames and hence, for the sake of convenience, a frame where a light of R (red) is emitted twice is set as a first frame, and frames where a light of G (green) and a light of B (blue) are emitted twice are set as a second frame and a third frame respectively. This placement is explained again later in conjunction with the explanation of a graph shown in FIG. 35. This prior art is described in detail in a second embodiment of the invention described in JP 2007-206698 A.

SUMMARY OF THE INVENTION

FIG. 33 is a lighting timing chart with respect to the first prior art shown in FIG. 32, wherein time is taken on an axis of abscissas, and lighting timing of a light source of R (red) is expressed as an example. To facilitate the understanding of the lighting timing, timings at which light sources of G (green) and B (blue) are lit are also indicated by a broken line along with the lighting timing of the light source of R (red). Further, alight emitting cycle completes one turn for every three frames and hence, for the sake of convenience, a frame which starts with R (red) is set as the first frame, and frames which start with G (green) and B (blue) are set as the second frame and the third frame respectively.

Here, to overview the timing at which the light source of R (red) is lit, it is understood that the lighting of the light source of R (red) is concentrated around the third frame. That is, time average brightness of the light source of R (red) is increased at frequency which is 1/3 of the frame frequency for every third frame. Although the frame frequency is set to 60 Hz, for example, for preventing flicker noises from reaching a human eye, a brightness signal which is repeated at 20 Hz which is the frequency which is 1/3 of 60 Hz is easily recognized by the human eye. Accordingly, in a display device which uses the first prior art, a viewer visually recognizes low-frequency flicker noises having frequency which is 1/3 of the frame frequency with respect to R (red) which appear on a screen thus giving rise to a drawback that the viewer recognizes remarkable degradation of image quality. The same goes for G (green) and B (blue).

The above-mentioned drawback arises also in the second prior art shown in FIG. 34 in the same manner. FIG. 35 is a lighting timing chart where only lighting of a light source of R (red) is sampled as an example with respect to the second prior art shown in FIG. 34. Since lighting timings and brightnesses of light sources of G (green) and B (blue) are also easily obtained from FIG. 34 in the same manner and hence, the explanation of these timings and brightnesses is omitted for the sake of brevity. In FIG. 34 and FIG. 35, a light emitting cycle completes one turn for every three frames and hence, for the sake of convenience, a frame where a light of R (red) is emitted twice is set as a first frame, and a frame where a light of G (green) is emitted twice is set as a second frame, and a frame where a light of B (blue) is emitted twice is set as a third frame respectively.

Also in the second prior art, to overview the timing at which the light source of R (red) is lit in the same manner as the first prior art, it is understood that the lighting of the light source of R (red) is concentrated around a latter half of the first frame, while the lighting of the light source of R (red) is scarce in a front half of the third frame. In the second prior art, it is described that flickers can be decreased by setting the number of times of light emission larger than the frame frequency. However, we have made a finding through our experiment that an object which a viewer visually recognizes in reality is not an image in accordance with a frame unit but a series of continuous light emissions and hence, when a light emission component having frequency equal to or less than frame frequency is present, the viewer recognizes flicker noises. The presence or the non-presence of the light emission component having frequency equal to or less than frame frequency is a concept completely different from the elimination of the brightness difference for every frame. Accordingly, even when the second prior art is adopted, the brightness of the light source of R (red) becomes high at frequency which is 1/3 of the frame frequency for every latter half of the first frame. As described previously, a brightness signal which is repeated at frequency which is 1/3 of the frame frequency (for example, 20 Hz) is visually recognized by a human eye easily. Accordingly, also in a display device which uses the second prior art, the viewer visually recognizes low frequency flicker noises having frequency which is 1/3 of the frame frequency with respect to R (red) appearing on a screen thus giving rise to a drawback that the viewer recognizes the remarkable degradation of image quality. The same goes for G (green) and B (blue) in the same manner.

The present invention has been made in view of the above-mentioned circumstances, and it is an object of the present invention to provide a display device which can suppress flicker noises having frequency lower than frame frequency in a field sequential method.

According to one aspect of the present invention, there is provided a display device which includes: a light source which emits lights having plural different main wavelengths independently; a light emission control part which allows the light source to continuously emit the light having one main wavelength of the plural different main wavelengths in each of plural sub frames which are time widths in a period of 1 frame which is a display period for one screen; a display panel which controls the transmission of light irradiated from the light source in each pixel; and a display control part controls the display panel so as to transmit the light corresponding to a gray level value with respect to said each pixel of the display panel, wherein the light emitting control part performs the light emission of light having the first main wavelength in a first sub frame or performs the light emission of the light having the first main wavelength in a second sub frame in accordance with a light emission amount weighted based on a time for calculation including a first interval which is a interval between the first sub frame where the light having the first main wavelength which is one of the plural different main wavelengths is emitted and a second sub frame where the light having the first main wavelength is emitted subsequently after the first sub frame.

In the above-mentioned display device, the time for calculation may further include a second interval which is a interval between the first sub frame and a third sub frame which is arranged immediately before the first sub frame and in which the light having the first main wavelength is emitted.

In the above-mentioned display device, the interval may be a time interval which falls within a range from a time interval of a non-light emission period between the neighboring sub frames where the lights having the same main wavelength are emitted to a time interval between light emission centers of the neighboring sub frames.

In the above-mentioned display device, the interval may be a time interval between the light emission centers of neighboring sub frames where the lights having the same main wavelength are emitted.

In the above-mentioned display device, the interval may be a time interval of a non-light emission period between the neighboring sub frames where the lights having the same main wavelength are emitted.

In the above-mentioned display device, the weighted light emission amount may be brightness, and the light emission control part may perform the weighting such that the light emission amount is proportional to a magnitude of the time for calculation without changing a total light emission amount over predetermined number of frames. Here, "brightness" includes, for example, a change in visual brightness generated by turning on or off an LED (Light Emitting Diode) at a high speed in the meaning thereof.

In the above-mentioned display device, the above-mentioned 1 frame may be constituted of three sub frames of three colors of R (red), G (green) and B (blue).

In the above-mentioned display device, the above-mentioned 1 frame may be constituted of four sub frames in total consisting of three sub frames of three colors of R (red), G (green) and B (blue) and any one of the above-mentioned three frames of three colors of R (red), G (green) and B (blue).

In the above-mentioned display device, the above-mentioned 1 frame may be constituted of six sub frames.

In the above-mentioned display device, in the above-mentioned 1 frame, the placement of the sub frame where the light having a main wavelength in a range of green may be fixed.

In the above-mentioned display device, the light emission brightness in the sub frame where the light having the main wavelength in the range of green may change cyclically.

In the above-mentioned display device, one placement of the sub frames in the 1 frame is in normal order or in reverse order of R (red), G (green), R (red), B (blue), G (green) and R (red) and another placement of the sub frames in the 1 frame is in normal order or in reverse order of B (blue), G (green), B (blue), R (red), G (green) and B (blue), and the one placement and the another placement may be alternately repeated.

In the above-mentioned display device, one placement of the sub frames in the 1 frame is in normal order or in reverse order of R (red), G (green), R (red), B (blue), G (green) and R (red) and another placement of the sub frames in the 1 frame is in normal order or in reverse order of B (blue), G (green), R (red), B (blue), G (green) and B (blue), and, the one placement and the another placement may be alternately repeated.

In the above-mentioned display device, the display panel may perform light emission corresponding to a gray level value by controlling a time of light transmission.

In the above-mentioned display device, the display panel may use an MEMS (Micro-Electro-Mechanical System) shutter which performs light emission corresponding to a gray level value by controlling a time of light transmission.

In the above-mentioned display device, the display panel may use a DMD (Digital Mirror Device) shutter which performs light emission corresponding to a gray level value by controlling a time of light transmission.

In the above-mentioned display device, the display panel may use a liquid crystal shutter which allows the transmission of light corresponding to a gray level value by performing a control of brightness of a transmitting light.

In the above-mentioned display device, the light source may be formed of an LED (Light Emitting Diode), and the light emission brightness is controlled by turning on or off the LED.

DETAILED DESCRIPTION OF THE INVENTION

First Embodiment

Hereinafter, the constitution and the manner of operation of the first embodiment of the present invention are explained sequentially in conjunction with FIG. 1 to FIG. 5.

Figure 1:
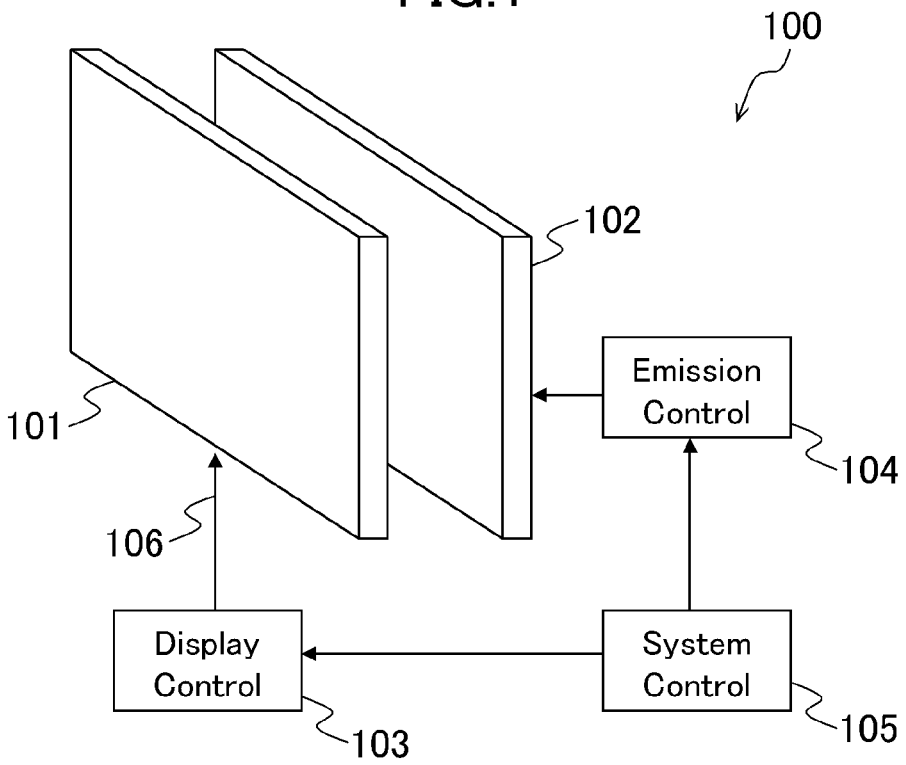
FIG. 1 is a system constitutional view of an image display device according to a first embodiment of the present invention.

FIG. 1 is a system constitutional view of an image display device 100 according to the first embodiment of the present invention. A system control circuit 105 is connected to a display control circuit 103 and a light emission control circuit 104, the system control circuit 105 is connected to a display panel 101 through a panel control line 106, and the light emission control circuit 104 is connected to a backlight light source 102. The system control circuit 105 transmits both image data corresponding to a display image and drive timings of the display panel 101 to the display control circuit 103, and transmits timings at which the backlight light source 102 emits light of any one of three colors consisting of R, G and B in synchronization with driving of the display panel 101 to the light emission control circuit 104. Upon receiving these signals, the display control circuit 103 and the light emission control circuit 104 respectively transmit signals necessary for driving the display panel 101 and the backlight light source 102 to the display panel 101 and the backlight light source 102.

Figure 2:
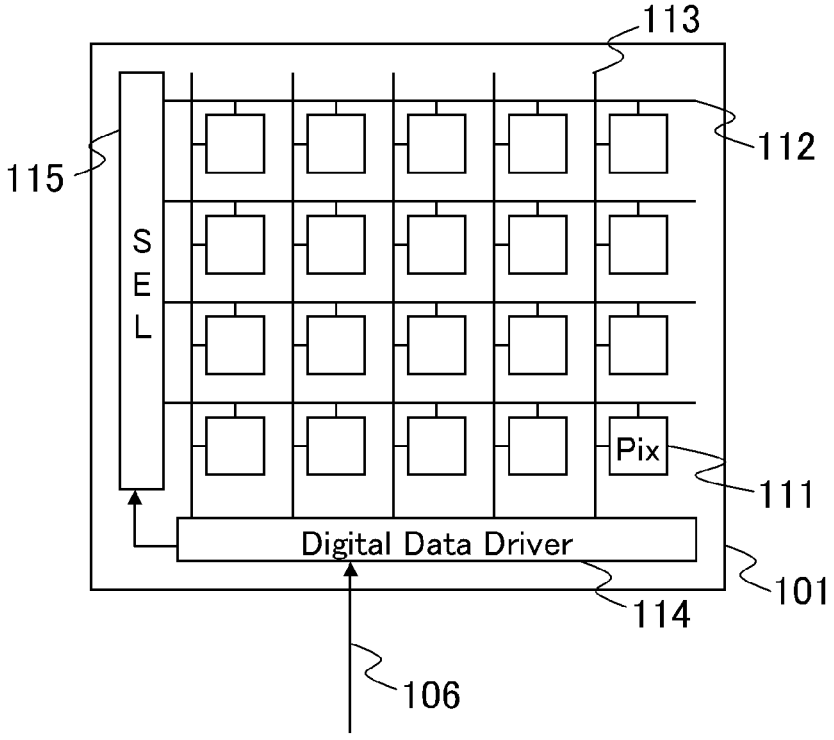
FIG. 2 is a constitutional view of a display panel shown in FIG. 1.

FIG. 2 is a constitutional view of the display panel 101. Pixels 111 are arranged in a display region of the display panel 101 in a matrix array, scanning lines 112 are connected to the pixels 111 in the row direction, and signal lines 113 are connected to the pixels 111 in the columnar direction. A scanning line scanning circuit (SEL) 115 is connected to one end of each scanning line 112, and one end of each signal line 113 is connected to a digital data driver 114. The scanning line scanning circuit 115 is controlled by a digital data driver 114, and a signal is inputted to the digital data driver 114 through the panel control line 106.

When image data and drive timings are inputted to the display panel 101 through the panel control line 106, the digital data driver 114 inputs digital image data to the signal lines 113 while controlling the scanning line scanning circuit 115 at a predetermined timing. An operation of each pixel 111 is controlled in response to a signal from the scanning line scanning circuit 115 through the scanning line 112, and the digital image data is fetched or displayed through the signal line 113 at predetermined timing.

Figure 3:
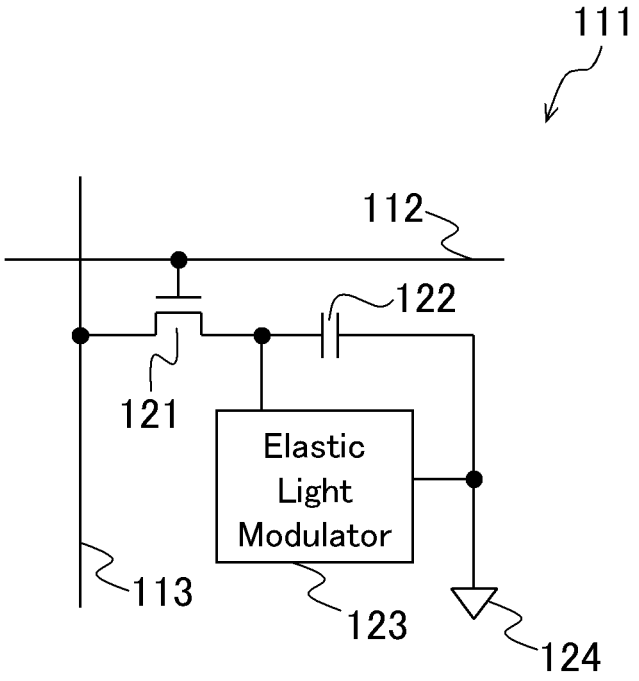
FIG. 3 is a view showing the constitution of a pixel shown in FIG. 2.

FIG. 3 shows the constitution of the pixel 111. The pixel 111 is constituted of a TFT switch 121 which has a gate thereof connected to the scanning line 112 and has one end of drain/source terminals thereof connected to the signal line 113, a signal holding capacitance 122 which is provided between the other end of the drain/source terminals of the TFT switch 121 and a common electrode 124, and an elastic light modulator 123 which is connected to both ends of the signal holding capacitance 122.

When the TFT switch 121 of the pixel 111 which the scanning line 112 selects is brought into an ON state, a high voltage or a low voltage which is digital image data written in the signal line 113 is written in the signal holding capacitance 122, and this signal voltage is held even after the scanning line 112 brings the TFT switch 121 into an OFF state. The high voltage or the low voltage written in the signal holding capacitance 122 is inputted to the elastic light modulator 123, and the elastic light modulator 123 controls the presence or the non-presence of blocking of light with respect to the backlight light source 102 based on the signal voltage. Here, the elastic light modulator 123 is binary controlled between ON and OFF. By performing the PWM (Pulse Width Modulation) of digital image data by bit weighting during a light emission period for every bit so that a gray level display of 8 bits can be performed. The elastic light modulator 123 is formed of an optical shutter using an MEMS (Micro Electro Mechanical System) technique, and the detailed structure and a gray level display operation of the optical shutter is described in detail in U.S. Pat. No. 7,304,785, Japanese Patent Application Publication JP2008-197668 and the like.

Here, each pixel 111 does not have a color decomposition means such as a color filter and, in this embodiment, coloring of the image display device 100 is controlled by a so-called field sequential display method where light emission colors of the backlight light source 102 are sequentially changed.

Figure 4A:
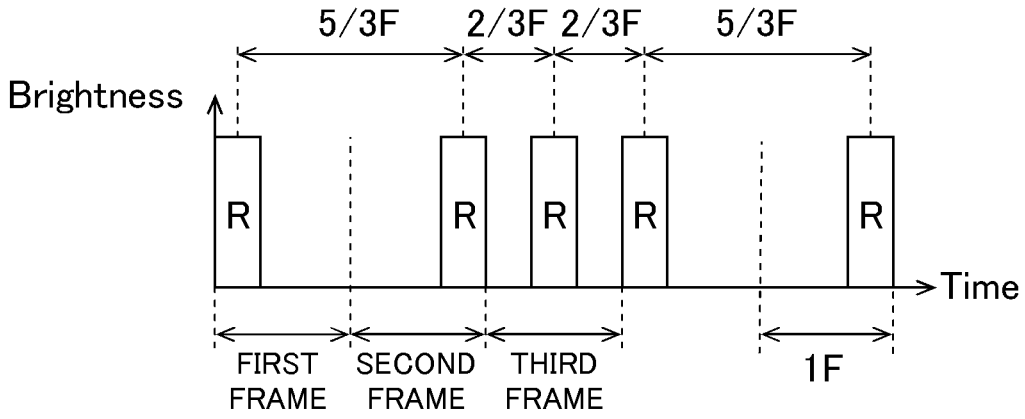
FIG. 4A is a lighting timing chart of an R (red) light source in the first embodiment.
Figure 32:
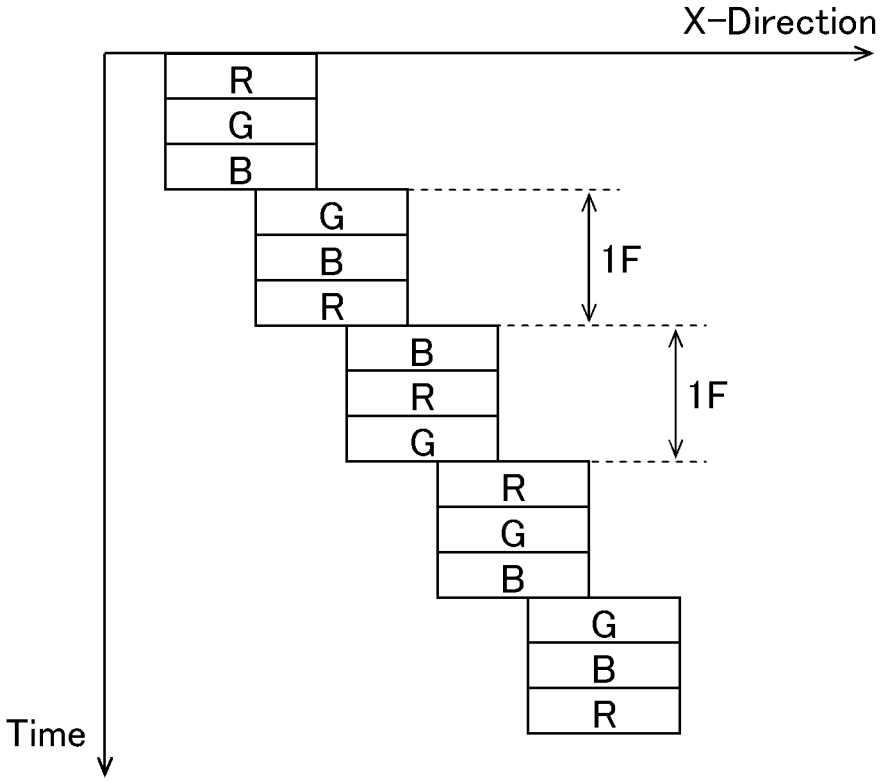
FIG. 32 is a schematic view of a moving image display in an image display device according to a first prior art.
Figure 33:
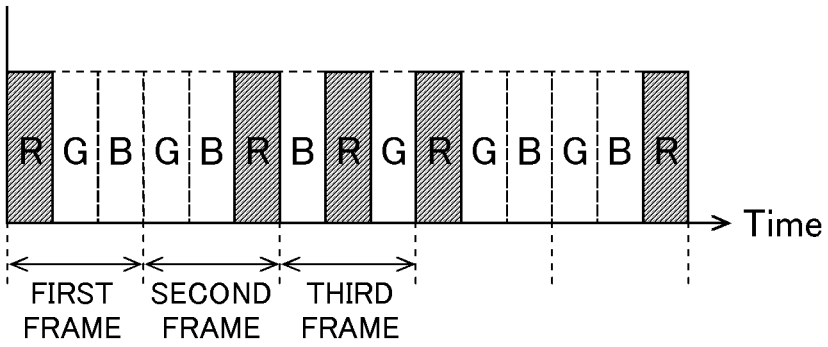
FIG. 33 is a lighting timing chart of the R (red) light emission in the image display device according to the first prior art.

FIG. 4A is a lighting timing chart of only the R (red) light source in the first embodiment. The lighting of each light source in the first embodiment is substantially equal to the timing in the first prior art explained in conjunction with FIG. 32 or FIG. 33 in terms of timing. The lighting of lights of G (green) and B (blue) described in FIG. 33 is omitted. The pixel in the first embodiment is digitally driven as described previously and hence, a rectangular sub frame described in FIG. 4A is, in the actual constitution, constituted of eight independent light emission periods where the light emission period is weighted for every bit of eight bits. However, the light emission periods corresponding to 8 bits are expressed as one sub frame for facilitating the understanding of the explanation.

Also in FIG. 4A, to allow the light emission period to complete one turn for every three frames, for the sake of convenience, a frame which starts with R (red) is set as a first frame, and frames which start with G (green) and B (blue) are set as a second frame and a third frame respectively. Here, a time for calculation used for calculating a weighting coefficient described later is defined based on a time interval between the light emission centers, and the time interval between the light emission centers of the R (red) light emission in the first frame and the R (red) light emission in the second frame is set to 5/3 (F). Here, 1 (F) expresses one frame period. In the same manner, a time interval between the light emission centers of the R (red) light emission in the second frame and the R (red) light emission in the third frame is set to 2/3 (F), and a time interval between the light emission centers of the R (red) light emission in the third frame and the R (red) light emission in the first frame is set to 2/3 (F). The subsequent time intervals are also substantially equal to the above-mentioned time intervals.

Figure 4B:
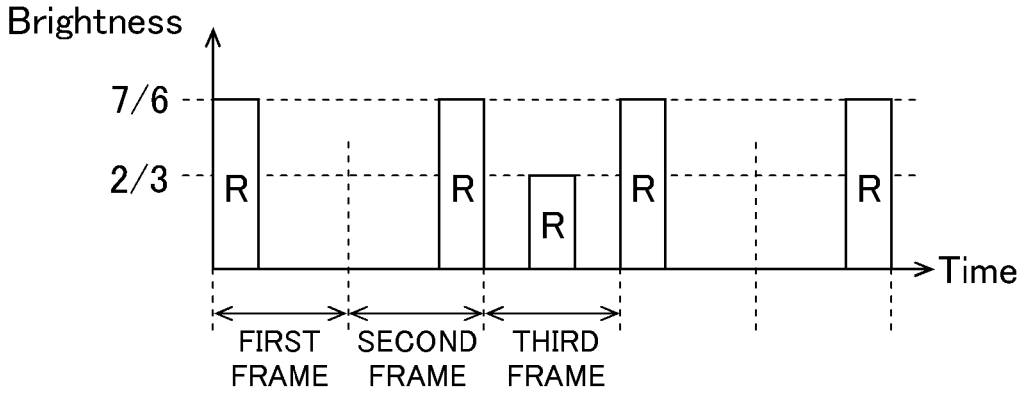
FIG. 4B is a light emission brightness timing chart relating to the R (red) light source in the first embodiment, wherein alight emission brightness is taken on an axis of ordinates.

FIG. 4B is a light emission brightness timing chart relating to an R (red) light source in the first embodiment. Although time is taken on an axis of abscissas in the same manner as FIG. 4A, the light emission brightness is taken on an axis of ordinates in FIG. 4B. In the light emission brightness timing chart shown in FIG. 4B, the sub frame individually expressed in a rectangular shape is, in the actual constitution, constituted of eight independent light emission periods where the light emission period is weighted for every bit by the display panel 101. However, this expression of the sub frame means that, in the light emission of the backlight light source 102, all light emission in eight independent light emission periods are adjusted to the same brightness taken on the axis of brightness. Here, the light emission brightness of each color is weighted based on the time for calculation defined by a sum of time intervals between the light emission center of the sub frame and the light emission centers of sub frames before and after the sub frame in which light of the same color as the sub frame is emitted such that the total light emission amount within the continuous 3 (F) is not changed. To be more specific, with respect to light emission intervals before and after the R (red) light emission in the second frame, the time interval between the light emission centers before the R (red) light emission is 5/3 (F), and the time interval between the light emission centers after the R (red) light emission is 2/3 (F) and hence, the time for calculation is 7/3 (F) which is a sum of both light emission intervals, and 7/6 (F) which is 1/2 (average) of 7/3 is used as a weighting coefficient. In the same manner, light emission intervals before and after the R (red) light emission in the third frame are 2/3 (F) and 2/3 (F) respectively and hence, the time for calculation is obtained as 4/3 (F) which is a sum of both light emission intervals, and 2/3 which is 1/2 (average) of 4/3 (F) is set as a weighting coefficient. The light emission brightnesses in FIG. 4B are obtained by setting the light emission intervals obtained in this manner as the weighting coefficients with respect to the respective light emissions.

Figure 5:
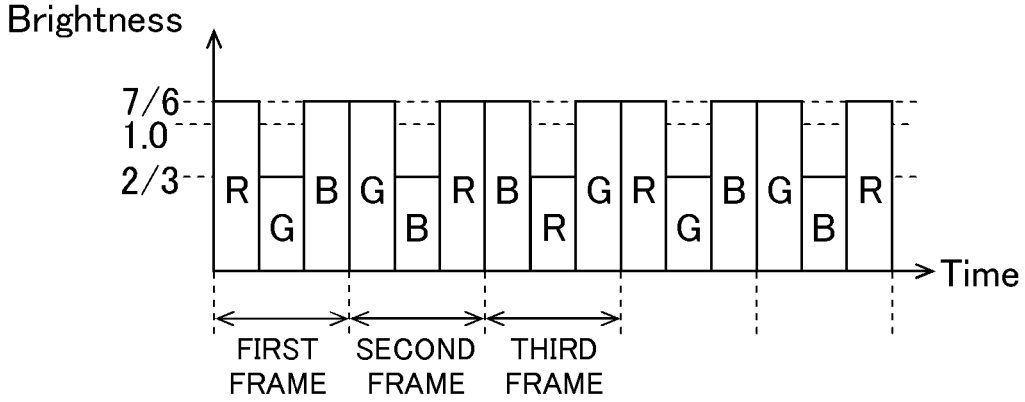
FIG. 5 is a light emission brightness timing chart relating to R (red), G (green) and B (blue) light sources in the first embodiment.

FIG. 5 is a light emission brightness timing chart relating to light sources of three colors of R (red), G (green) and B (blue) obtained in this manner. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit. In this embodiment, the light emission order of R (red), G (green) and B (blue) is changed for every frame and hence, it is also possible to acquire an advantageous effect of suppressing the color decomposition with respect to a moving image.

In this embodiment, the pixel 111 which is constituted of a TFT circuit mounted on a glass substrate is driven by the digital data driver 114 and the scanning line scanning circuit 115 which are respectively constituted of silicon LSI. However, the application of the present invention is not limited to such a constitution, and is also applicable to a case where all these circuit elements are constituted of a TFT on a single insulating transparent substrate, a case where these circuit elements are realized by a single crystal Si element including a pixel on an SOI (Silicon On Insulator) substrate or the like without departing from the gist of the present invention. Further, although the 8 bit display is adopted in this embodiment, the present invention is also easily applicable to a 6 bit display or a display of other bits without departing from the gist of the present invention.

In this embodiment, a time for calculation used for calculating a weighting coefficient is defined based on a time interval between light emission centers. However, provided that the light emission periods are equal, the time for calculation may be defined as a period between a light emission start position and a light emission start position or a period between a light emission finish position and a light emission finish position.

In this embodiment, the elastic light modulator 123 is formed of the optical shutter which adopts an MEMS (Micro Electro Mechanical System) technique. However, the present invention does not depend on the constitution and the manner of operation of the elastic light modulator 123 particularly and hence, the elastic light modulator 123 may adopt a DMD (Digital Mirror Device) or other elastic light modulator structures.

In this embodiment, the adjustment of light emission amounts in the respective light emission periods of R (red), G (green) and B (blue) is performed by directly controlling brightnesses. However, the adjustment of light emission amounts can be performed in the substantially same manner by modulating light emission periods. For example, an LED (Light Emitting Diode) is used as a backlight light source, and light emission amounts (brightnesses) can be controlled by performing only a timing control where the LED is turned on or off at a high speed without changing a light emission current supplied to the LED. In this case, although an LED light emission timing control program becomes complicated, an LED drive circuit can be more simplified. Here, the light emission amount control which is performed by turning on or off the LED at a high speed by the light emission control circuit 104 is also included in the context that "brightnesses" are controlled.

In this embodiment, the explanation has been made with respect to three kinds of light emission of R (red), G (green) and B (blue). However, even when the light emission colors include other colors such as W (white) or Y (yellow), the technical concept of this embodiment is applicable to such a case.

The above-mentioned modifications are not limited to this embodiment, and are also applicable to embodiments described hereinafter.

Second Embodiment

The system constitution of an image display device, the constitution of a display panel and the constitution of a pixel according to the second embodiment are substantially equal to the corresponding constitutions according to the above-mentioned first embodiment and hence, the explanation of these constitutions is omitted.

Figure 6A:
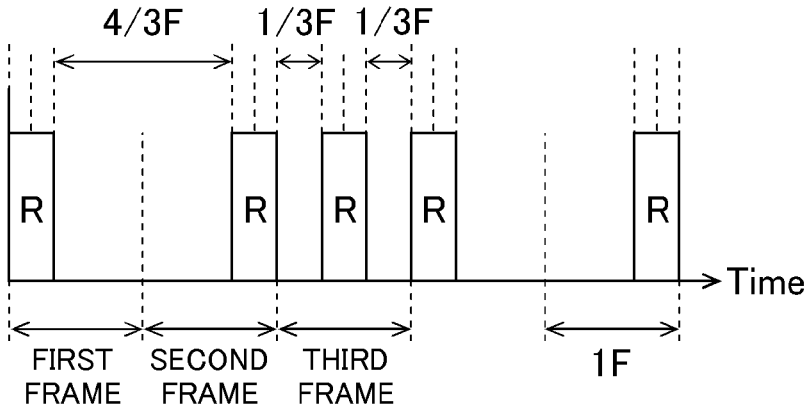
FIG. 6A is a lighting timing chart of an R (red) light source according to a second embodiment.

FIG. 6A is a lighting timing chart of only an R (red) light source in the second embodiment. The lighting timing of each light source in the second embodiment is substantially equal to the corresponding lighting timing in the first embodiment. In the second embodiment, a time for calculation used for calculating a weighting coefficient is defined based on a time interval of a non-light emission period. The time interval of the non-light emission period between the R (red) light emission in a first frame and the R (red) light emission in a second frame is 4/3 (F). In the same manner, a time interval of the non-light emission period between the R (red) light emission in the second frame and the R (red) light emission in a third frame is 1/3 (F), and the time interval of the non-light emission period between the R (red) light emission in the third frame and the R (red) light emission in the next first frame is 1/3 (F). The subsequent time intervals are also substantially equal to the above-mentioned time intervals.

Figure 6B:
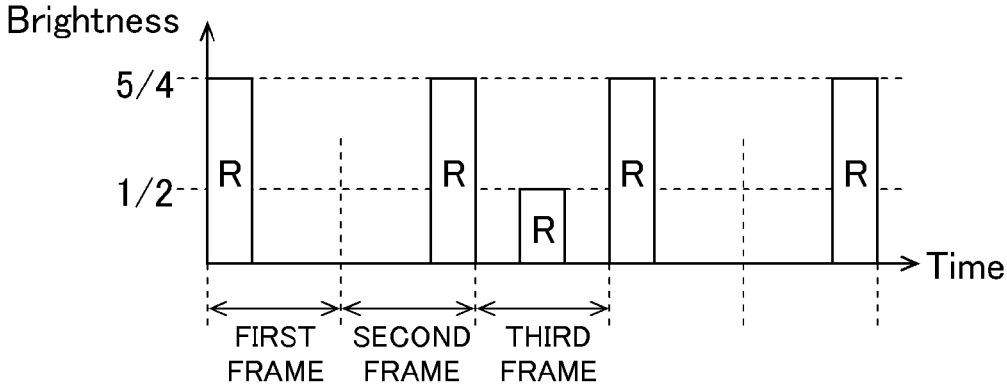
FIG. 6B is a light emission brightness timing chart of the R (red) light source in the second embodiment.

FIG. 6B is a light emission brightness timing chart relating to the R (red) light source in the second embodiment. Although time is taken on an axis of abscissas in the same manner as FIG. 6A, the light emission brightness is taken on an axis of ordinates in FIG. 6B. Here, the light emission brightness of each color is weighted based on a time for calculation defined by a sum of time intervals of the non-light emission periods between the sub frame and sub frames before and after the sub frame in which light of the same color of the sub frame is emitted such that the total light emission amount within the continuous 3 (F) is not changed. To be more specific, with respect to the light emission intervals before and after the R (red) light emission in the second frame, the time interval of the non-light emission period before the R (red) light emission is 4/3 (F), and the time interval of the non-light emission period after the R (red) light emission is 1/3 (F) and hence, the time for calculation is 5/3 (F) which is a sum of both time intervals of the non-light emission periods. In the same manner, light emission intervals before and after the R (red) light emission in the third frame are 1/3 (F) and 1/3 (F) respectively and hence, the time for calculation is obtained as 2/3 (F) which is a sum of both time intervals of the non-light emission periods. Weighting coefficients are set to 5/4 and 1/2 which are obtained by multiplying these times for calculation by 3/4 such that the total light emission amount within the continuous 3 (F) is not changed. The light emission brightnesses in FIG. 6B are obtained by setting the light emission intervals obtained in this manner as the weighting coefficients with respect to the respective light emissions.

Figure 7:
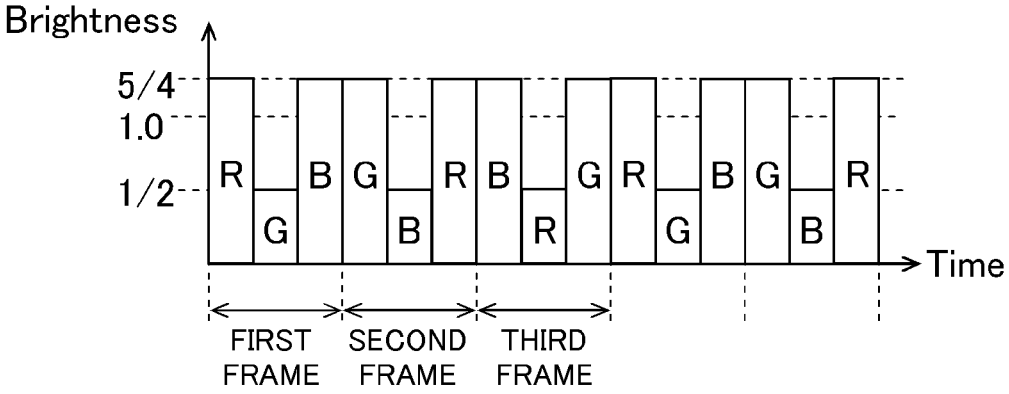
FIG. 7 is a light emission brightness timing chart relating to R (red), G (green) and B (blue) light sources in the second embodiment.

FIG. 7 is a light emission brightness timing chart relating to light sources of three colors of R (red), G (green) and B (blue) obtained in this manner. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit. In this embodiment, the light emission order of R (red), G (green) and B (blue) is changed for every frame and hence, it is also possible to acquire an advantageous effect of suppressing the color decomposition with respect to a moving image.

The difference between the weighting used in the first embodiment and the weighting used in the second embodiment is explained hereinafter. As described previously, the period during which the light emission is continued is also taken into the calculation in the former, while the period during which the light emission is continued is not taken into the calculation in the latter. That is, in the former, the light emission almost approximates the light emission which is instantaneously performed. According to a visual characteristic of a man, the image retention is extremely small with respect to a high brightness portion. Accordingly, it is understood that the weighting used in the first embodiment is the approximation suitable for a high brightness display gray level region particularly. On the other hand, the calculation is made by excluding the light emission period in the latter. According to a visual characteristic of a man, the image retention is increased with respect to a low brightness portion and hence, it is understood that the weighting used in the second embodiment is the approximation suitable for a low-brightness display gray level region particularly. In this manner, it is preferable to properly use the weighting coefficient used in the first embodiment and the weighting coefficient used in the second embodiment separately between the high brightness portion and the low brightness portion in an image. However, from a viewpoint of simplifying the system practically, it is desirable to select either one of these weighting coefficients or to fix the weighting coefficient to a proper value between both weighting coefficients by taking into account a display image quality in general.

The time interval between the light emission centers of the neighboring sub frames in which the light of the same color is emitted is used in the first embodiment, while the time interval of the non-light emission period between the neighboring sub frames in which the light of the same color is emitted is used in the second embodiment. However, a time interval which falls within a range between these time intervals may be also used. Also in this case, the light emission control substantially equal to the light emission control in the first embodiment or the second embodiment can be performed.

Third Embodiment

The system constitution of an image display device, the constitution of a display panel and the constitution of a pixel according to the third embodiment are substantially equal to the corresponding constitutions according to the above-mentioned first embodiment and hence, the explanation of these constitutions is omitted.

Figure 8A:
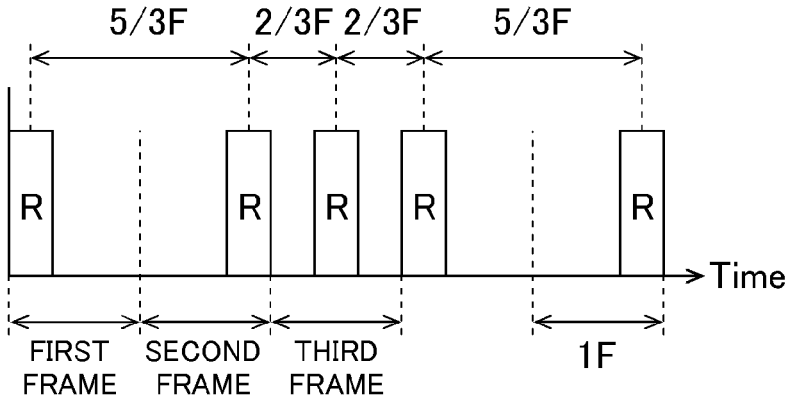
FIG. 8A is a lighting timing chart of an R (red) light source in a third embodiment.

FIG. 8A is a lighting timing chart of only an R (red) light source in the third embodiment. The lighting timing of each light source in the third embodiment is substantially equal to the corresponding lighting timing in the first embodiment. As shown in FIG. 8A, in the third embodiment, in the same manner as the first embodiment, a time for calculation used for calculating a weighting coefficient is defined based on a time interval between light emission centers. The time interval between respective light emission centers of the R (red) light emission in a first frame and the R (red) light emission in a second frame is 5/3 (F). In the same manner, the time interval between respective light emission centers of the R (red) light emission in the second frame and the R (red) light emission in a third frame is 2/3 (F), and the time interval between respective light emission centers of the R (red) light emission in the third frame and the R (red) light emission in the next first frame is 2/3 (F). The subsequent time intervals are also substantially equal to the above-mentioned time intervals.

Figure 8B:
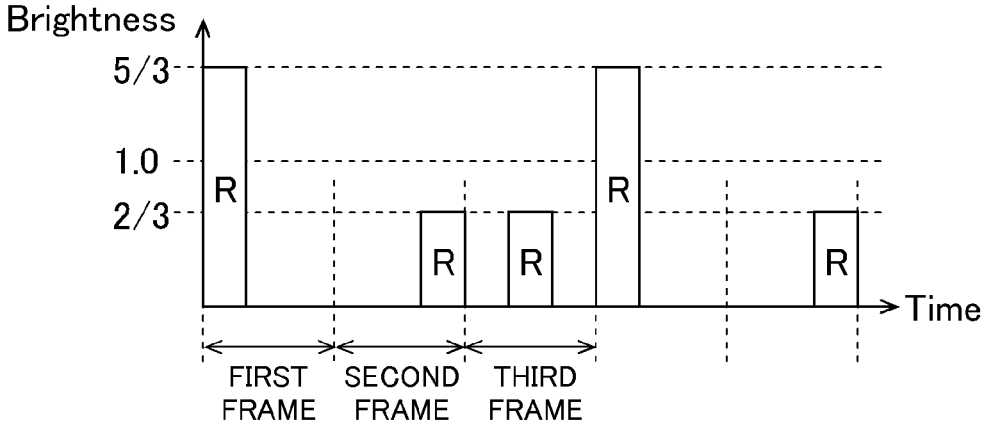
FIG. 8B is a light emission brightness timing chart of the R (red) light source in the third embodiment.

FIG. 8B is a light emission brightness timing chart relating to an R (red) light source in the third embodiment. Although time is taken on an axis of abscissas in the same manner as FIG. 8A, the light emission brightness is taken on an axis of ordinates in FIG. 8B. Here, the light emission brightness of each color is weighted based on a time for calculation defined by time interval between the light emission center of the sub frame and the light emission center of sub frame after the sub frame in which light of the same color of the sub frame is emitted such that a total light emission amount within continuous 3 (F) is not changed. To be more specific, with respect to a weighting coefficient in each light emission, the interval between the light emission center and the next light emission center obtained in FIG. 8A is the time for calculation, and the weighting coefficients for the R (red) light emissions in the first frame, the second frame and the third frame are 5/3, 2/3 and 2/3 respectively in this order.

Figure 9:
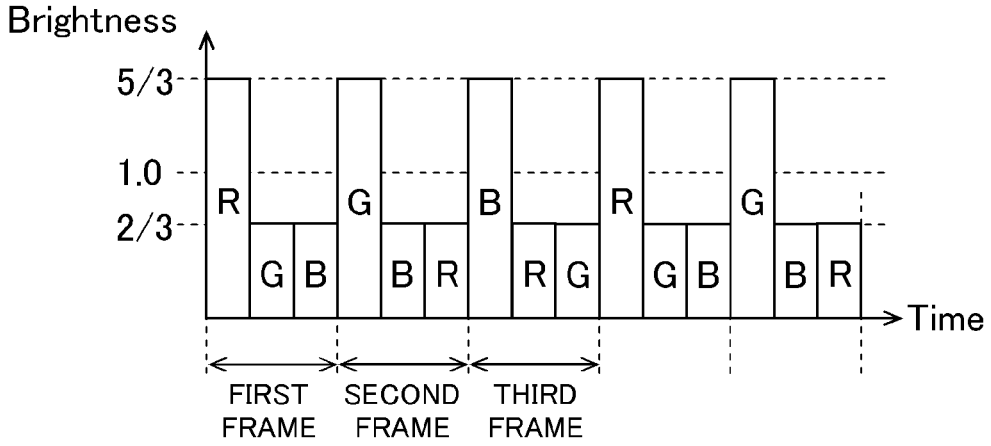
FIG. 9 is a light emission brightness timing chart relating to R (red), G (green) and B (blue) light sources in the third embodiment.

FIG. 9 is a light emission brightness timing chart relating to light sources of three colors of R (red), G (green) and B (blue) obtained in this manner. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit. In this embodiment, the light emission order of R (red), G (green) and B (blue) is changed for every frame and hence, it is also possible to acquire an advantageous effect of suppressing the color decomposition with respect to a moving image.

The difference between the weighting coefficient used in the first and second embodiments and the weighting coefficient used in the third embodiment in the acquisition of these weighting coefficients by calculation is explained hereinafter. As described previously, the periods before and after the light emission are taken into the calculation in the first and second embodiments, while only the period after the light emission is taken into the calculation in the third embodiment. That is, in the former, the time-average light emission is approximated. According to a visual characteristic of a man, the image retention is extremely small under a high illuminance environment. Accordingly, it is understood that the weighting coefficient used in the first and second embodiments is the approximation suitable for a case where an image is visually recognized under a particularly bright environment. On the other hand, in the latter, the weighting coefficient is calculated based on the period during which the light emission visually remains as the image retention. According to a visual characteristic of a man, the image retention is remarkably increased under a low illuminance environment. Accordingly, it is understood that the weighting coefficient used in the third embodiment is the approximation suitable for a case where an image is visually recognized in a particularly dark environment. In this manner, it is preferable that the method of calculating the weighting coefficient used in the first and second embodiments and the method of calculating the weighting coefficient used in the third embodiment be variable, and can be suitably separately used depending on the brightness of the environment. Alternatively, when it is necessary to fix the weighting coefficient in terms of the system, it is desirable to select either one of both weighting coefficients or to fix the weighting coefficient to a proper value between both weighting coefficients by taking into account a use method and a use environment of a display image.

Fourth Embodiment

The system constitution of an image display device, the constitution of a display panel and the constitution of a pixel according to the fourth embodiment are substantially equal to the corresponding constitutions according to the above-mentioned first embodiment and hence, the explanation of these constitutions is omitted.

Figure 10A:
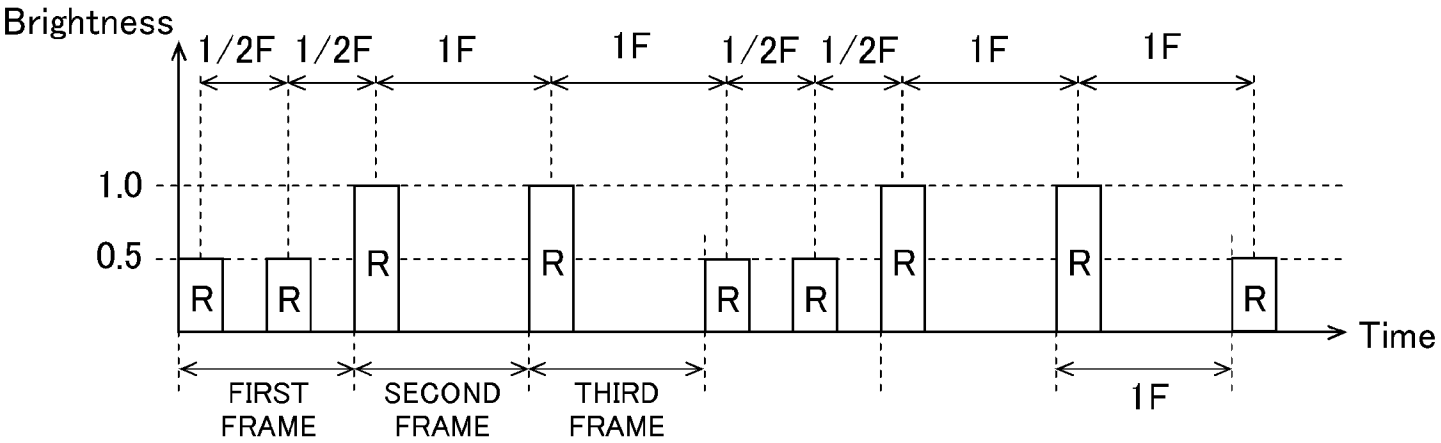
FIG. 10A is a light emission brightness timing chart relating to an R (red) light source shown in FIG. 34.
Figure 34:
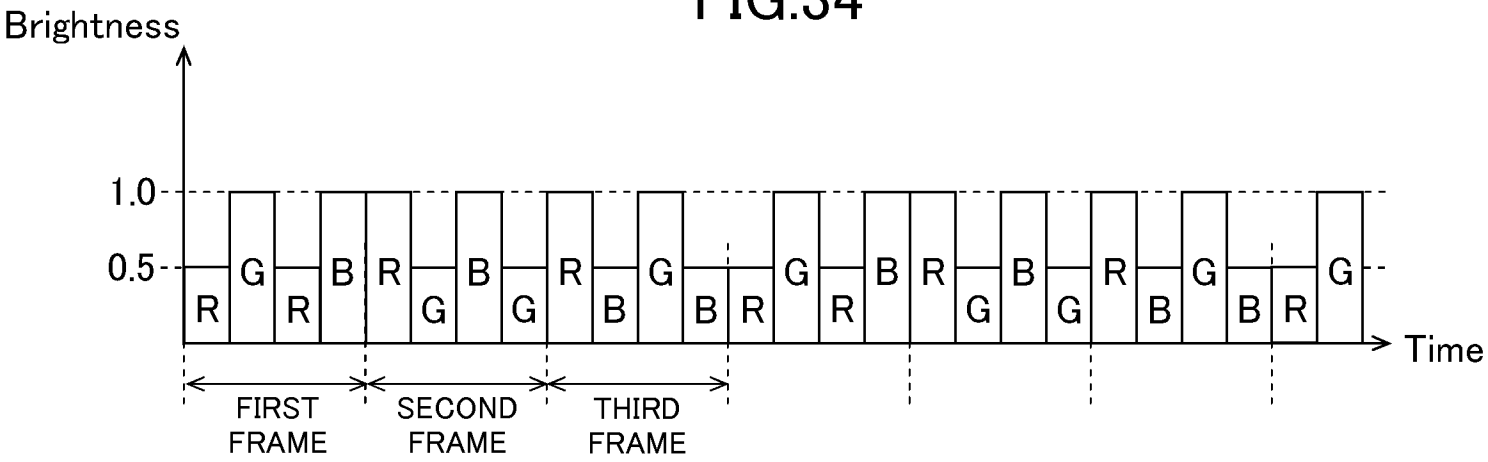
FIG. 34 is a timing chart of light emission brightness in an image display device according to a second prior art.
Figure 35:
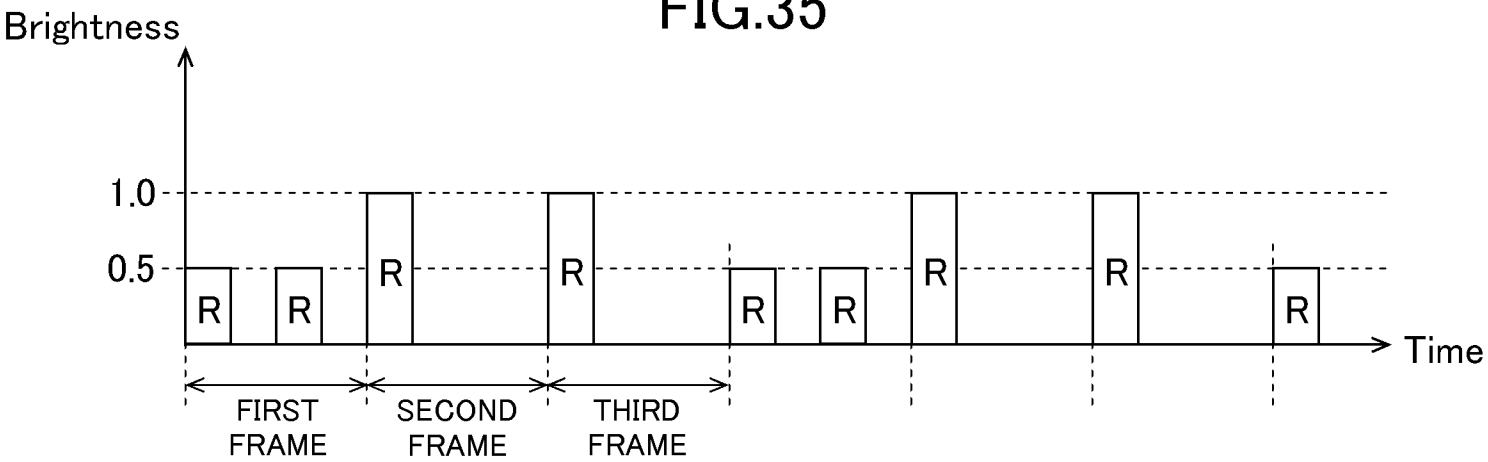
FIG. 35 is a lighting timing chart of the R (red) light emission in the image display device according to the second prior art.

FIG. 10A is a light emission brightness timing chart relating to an R (red) light source in the fourth embodiment, and the definition of a first frame, a second frame and a third frame is substantially equal to the definition used in the second prior art shown in FIG. 34. As shown in FIG. 10A, in the fourth embodiment, a time for calculation used for calculating a weighting coefficient is defined based on a time interval between light emission centers. The time interval between the light emission center of the R (red) light emission in a latter half of the first frame and the light emission center of the R (red) light emission in the second frame is 1/2 (F). In the same manner, the time interval between the light emission center of the R (red) light emission in the second frame and the light emission center of the R (red) light emission in the third frame is 1 (F), the time interval between the light emission center of the R (red) light emission in the third frame and the light emission center of the R (red) light emission in a front half of the next first frame is 1 (F), and the time interval between the light emission center of the R (red) light emission in the front half of the first frame and the light emission center of the R (red) light emission in the latter half of the next first frame is 1/2 (F). The subsequent time intervals are also substantially equal to the above-mentioned time intervals.

Figure 10B:
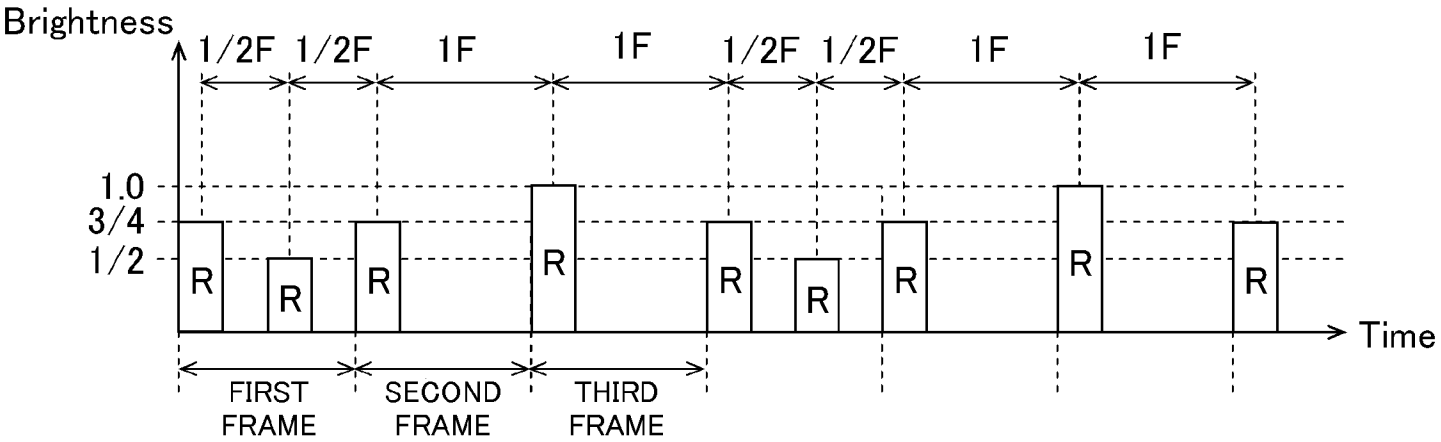
FIG. 10B is a light emission brightness timing chart of the R (red) light source in a fourth embodiment.

FIG. 10B is a light emission brightness timing chart relating to the R (red) light source in the fourth embodiment. In the fourth embodiment, the light of the same color is emitted plural times within the same frame. As explained previously in conjunction with the first embodiment, light emission periods individually expressed in a rectangular shape are, in the actual constitution, constituted of eight independent light emission periods where the light emission period is weighted for every bit by a display panel 101. This expression of the light emission period means that, in the light emission formed of two sets of light emission periods set in the same frame in FIG. 10B where each set of light emission period is constituted of eight independent light emission periods, the respective brightness of the light emissions are adjusted to values expressed on an axis of ordinates. Here, the light emission brightness of each color is weighted based on a time for calculation defined by a sum of time intervals between the light emission center of the sub frame and the light emission centers of sub frames before and after the sub frame in which light of the same color as the sub frame is emitted such that the total light emission amount within the continuous 3 (F) is not changed. For example, with respect to light emission intervals before and after the R (red) light emission in the third frame, the time interval between the light emission centers before the R (red) light emission is 1 (F), and the time interval between the light emission centers after the R (red) light emission is 1 (F) and hence, the time for calculation is 2 which is a sum of both light emission intervals, and a weighting coefficient becomes 1 which is 1/2 (average) of the time for calculation. In the same manner, light emission intervals before and after the R (red) light emission in the front half of the first frame are 1 (F) and 1/2 (F) respectively and hence, the time for calculation is 3/2 (F) which is a sum of both light emission intervals, and a weighting coefficient is 3/4 which is 1/2 (average) of the time for calculation. The light emission intervals before and after the R (red) light emission in the latter half of the first frame are 1/2 (F) and 1/2 (F) respectively and hence, the time for calculation is 1 (F) which is a sum of both light emission intervals, and a weighting coefficient is 1/2 which is 1/2 (average) of the time for calculation. The light emission brightnesses in FIG. 10B are obtained by setting the light emission intervals obtained in this manner as the weighting coefficients with respect to the respective light emissions. Due to such processing, with respect to the light emission brightness of the R (red) light emission in each light emission period, the light emission brightness in the front half of the first frame is weighted by 3/4, the light emission brightness in the latter half of the first frame is weighted by 1/2, the light emission brightness in the second frame is weighted by 3/4, and the light emission brightness in the third frame is weighted by 1.0.

Figure 11A:
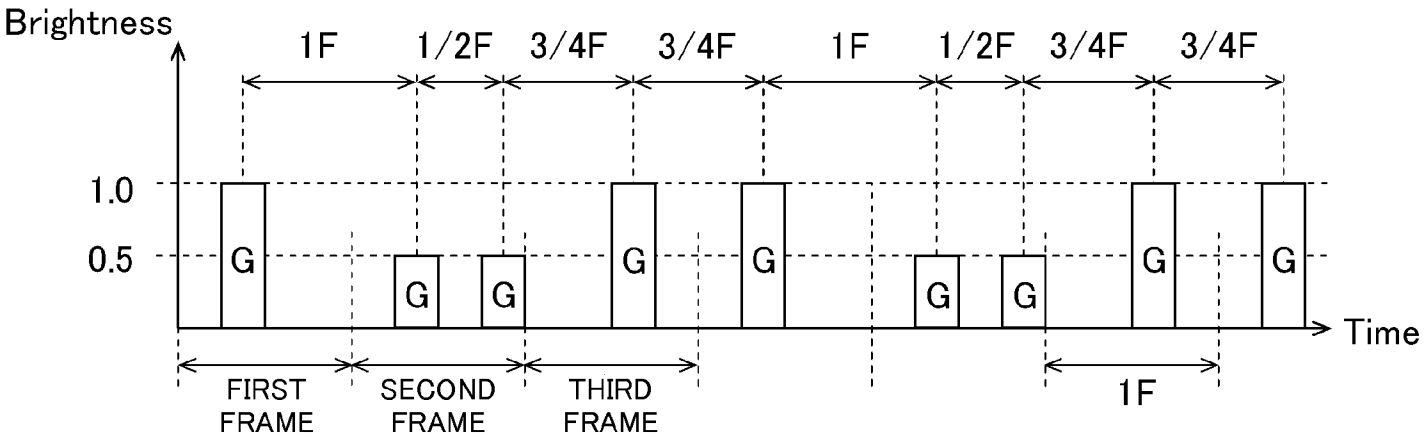
FIG. 11A is a light emission brightness timing chart relating to a G (green) light source shown in FIG. 34.

FIG. 11A is a light emission brightness timing chart relating to a G (green) light source in the fourth embodiment, and the definition of the first frame, the second frame and the third frame is substantially equal to the definition used in the second prior art shown in FIG. 34. As shown in FIG. 11A, the time interval between the light emission center of the G (green) light emission in the first frame and the light emission center of the G (green) light emission in the second frame is 1 (F). In the same manner, the time interval between the light emission center of the G (green) light emission in a front half of the second frame and the light emission center of the G (green) light emission in a latter half of the second frame is 1/2 (F), the time interval between the light emission center of the G (green) light emission in a latter half of the second frame and the light emission center of the G (green) light emission in the next third frame is 3/4 (F), and the time interval between the light emission center of the G (green) light emission in the third frame and the light emission center of the G (green) light emission in the next first frame is 3/4 (F). The subsequent time intervals are also substantially equal to the above-mentioned time intervals.

Figure 11B:
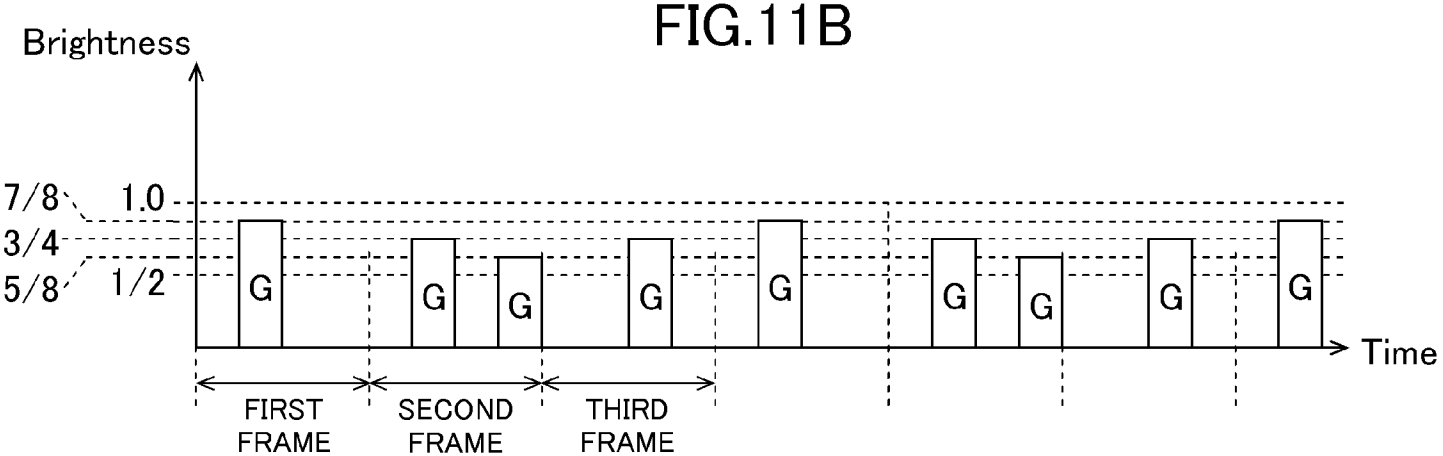
FIG. 11B is a light emission brightness timing chart of the G (green) light source in the fourth embodiment.

FIG. 11B is a light emission brightness timing chart relating to the G (green) light source in the fourth embodiment. For example, with respect to light emission intervals before and after the G (green) light emission in the first frame, the time interval between the light emission centers before the G (green) light emission is 3/4 (F), and the time interval between the light emission centers after the G (green) light emission is 1 (F) and hence, a weighting coefficient is obtained as 7/8 which is 1/2 (average) of a sum of both time intervals. In the same manner, light emission intervals before and after the G (green) light emission in the front half of the second frame are 1 (F) and 1/2 (F) respectively and hence, a weighting coefficient is obtained as 3/4 (F) which is 1/2 (average) of a sum of both light emission intervals and the light emission intervals before and after the G (green) light emission in the latter half of the second frame are 1/2 (F) and 3/4 (F) respectively so that a weighting coefficient is obtained as 5/8 which is 1/2 (average) of a sum of both light emission intervals. The light emission brightnesses in FIG. 11B are obtained by setting the light emission intervals obtained in this manner as the weighting coefficients with respect to the respective light emissions. Due to such processing, with respect to the light emission brightness of the G (green) light emission in each light emission period, the light emission brightness in the first frame is weighted by 7/8, the light emission brightness in the front half of the second frame is weighted by 3/4, the light emission brightness in the latter half of the second frame is weighted by 5/8, and the light emission brightness in the third frame is weighted by 3/4.

Figure 12A:
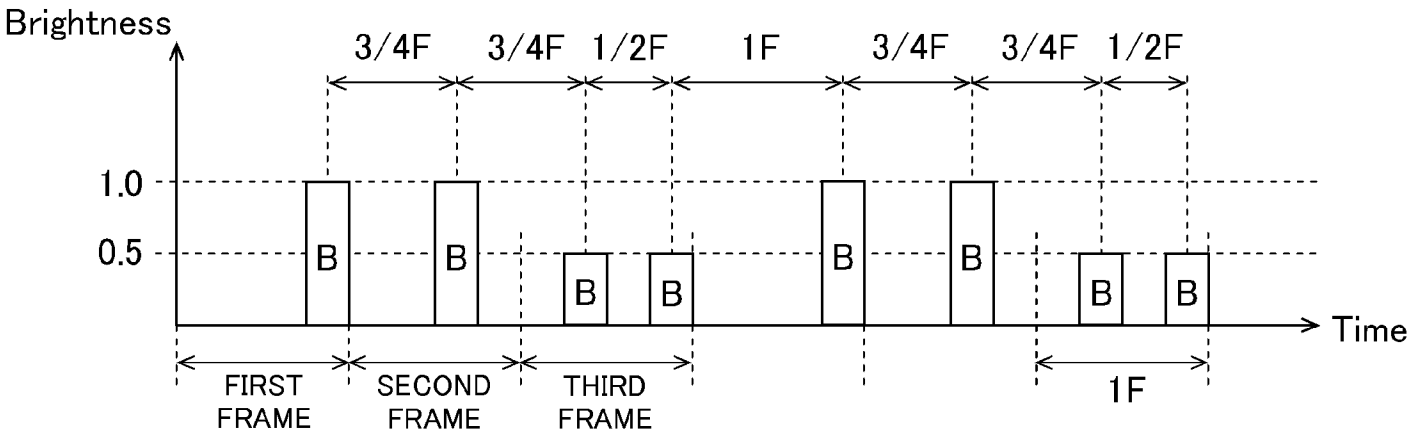
FIG. 12A is a light emission brightness timing chart relating to a B (blue) light source shown in FIG. 34.

FIG. 12A is a light emission brightness timing chart relating to a B (blue) light source in the fourth embodiment, and the definition of the first frame, the second frame and the third frame is substantially equal to the definition used in the second prior art shown in FIG. 34.

As shown in FIG. 12A, the time interval between the light emission center of the B (blue) light emission in the first frame and the light emission center of the B (blue) light emission in the second frame is 3/4 (F). In the same manner, the time interval between the light emission center of the B (blue) light emission in the second frame and the light emission center of the B (blue) light emission in a front half of the third frame is 3/4 (F), the time interval between the light emission center of the B (blue) light emission in a front half of the third frame and the light emission center of the B (blue) light emission in a latter half of the third frame is 1/2 (F), and the time interval between the light emission center of the B (blue) light emission in a latter half of the third frame and the light emission center of the B (blue) light emission in the next first frame is 1 (F). The subsequent time intervals are also substantially equal to the above-mentioned time intervals.

Figure 12B:
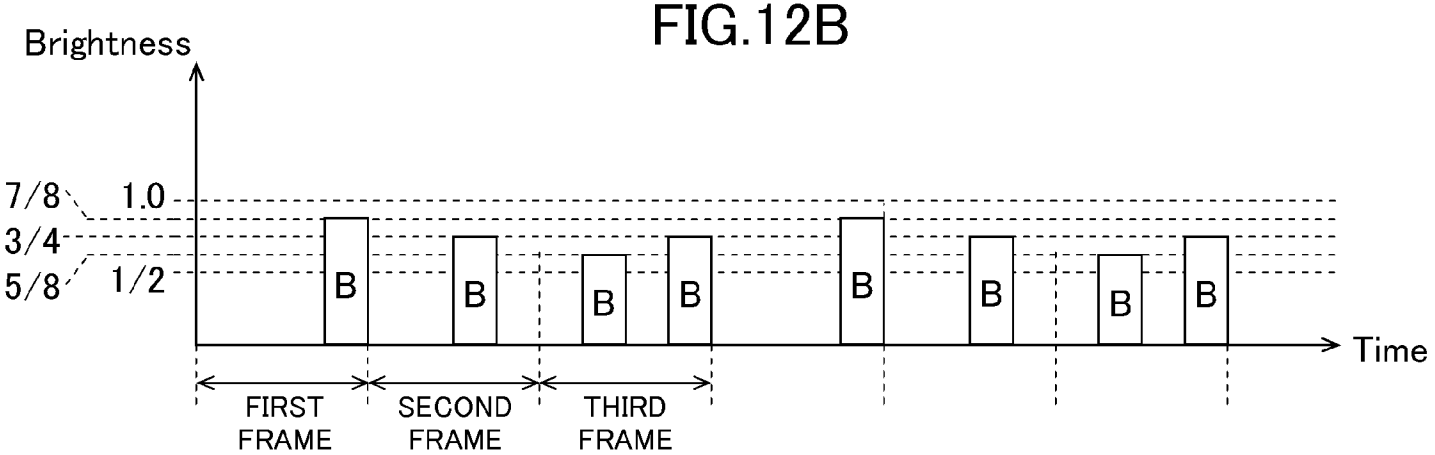
FIG. 12B is a light emission brightness timing chart of the B (blue) light source in the fourth embodiment.

FIG. 12B is a light emission brightness timing chart relating to the B (blue) light source in the fourth embodiment. For example, with respect to light emission intervals before and after the B (blue) light emission in the second frame, the time interval between the light emission centers before the B (blue) light emission is 3/4 (F), and the time interval between the light emission centers after the B (blue) light emission is 3/4 (F) and hence, a weighting coefficient is obtained as 3/4 which is 1/2 (average) of a sum of both time intervals. In the same manner, light emission intervals before and after the B (blue) light emission in the front half of the third frame are 3/4 (F) and 1/2 (F) respectively and hence, a weighting coefficient is obtained as 5/8 which is 1/2 (average) of a sum of both light emission intervals, and the light emission intervals before and after the B (blue) light emission in the latter half of the third frame are 1/2 (F) and 1 (F) respectively and hence, a weighting coefficient is obtained as 3/4 which is 1/2 (average) of a sum of both light emission intervals. The light emission brightnesses in FIG. 12B are obtained by setting the light emission intervals obtained in this manner as the weighting coefficients with respect to the respective light emissions. Due to such processing, with respect to the light emission brightness of the B (blue) light emission in each light emission period, the light emission brightness in the first frame is weighted by 7/8, the light emission brightness in the front half of the second frame is weighted by 3/4, the light emission brightness in the front half of the third frame is weighted by 5/8, and the light emission brightness in the latter half of the third frame is weighted by 3/4.

Figure 13:
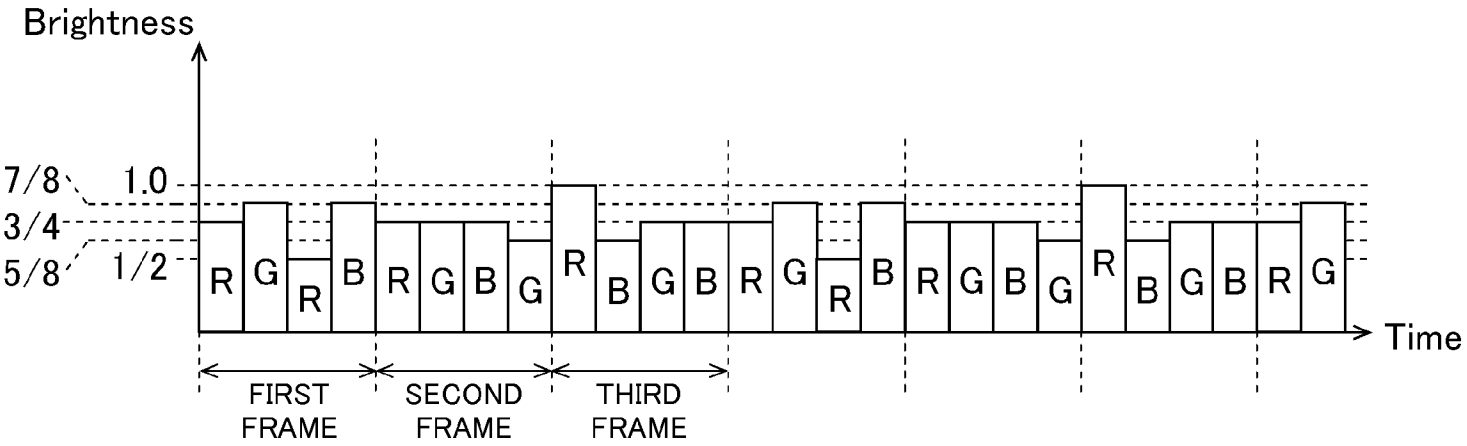
FIG. 13 is a light emission brightness timing chart of R (red), G (green) and B (blue) light sources in the fourth embodiment.

FIG. 13 is a light emission brightness timing chart relating to light sources of three colors of R (red), G (green) and B (blue) obtained as described above. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit. In this embodiment, the light emission order of R (red), G (green) and B (blue) is changed for every frame and hence, it is also possible to acquire an advantageous effect of suppressing the color decomposition with respect to a moving image.

Further, this embodiment has the technical feature that a weighting value of light emission amount is made different from each other among the R (red) light emission, the G (green) light emission and the B (blue) light emission. This technical feature is provided to cope with the constitution of the second prior art shown in FIG. 34 where the light emission order of R (red), G (green) and B (blue) is not equal. Particularly, when the light emission order is not equal with respect to each color, a weighting value of light emission amount may be made different with respect to the light emission in each color as in the case of this embodiment.

Fifth Embodiment

The system constitution of an image display device, the constitution of a display panel and the constitution of a pixel according to a fifth embodiment are substantially equal to the corresponding constitutions according to the above-mentioned first embodiment and hence, the explanation of these constitutions is omitted.

Figure 14:
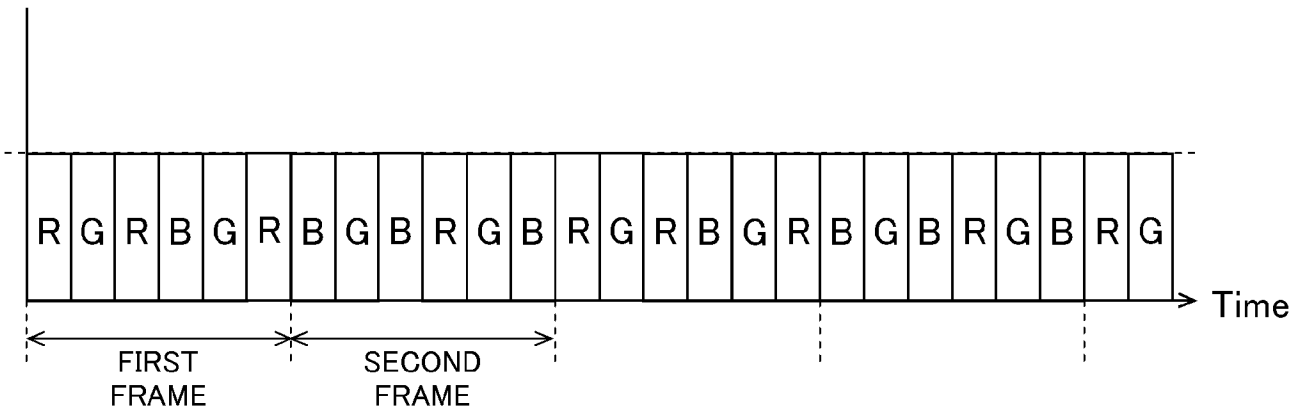
FIG. 14 is a lighting timing chart of R (red), G (green) and B (blue) light sources in a fifth embodiment.

FIG. 14 shows the light emission order devised this time to cope with the color decomposition in a field sequential display. Each frame is constituted of six sub frames in total consisting of the sub frames of R (red) light emission, the sub frames of G (green) light emission and the sub frames of B (blue) light emission, and the light emission order of the sub frames is made different between the odd-numbered first frame and the even-numbered second frame. To be more specific, the first frame is constituted of six sub frames of "R (red), G (green), R (red), B (blue), G (green) and R (red)", and the second frame is constituted of six sub frames of "B (blue), G (green), B (blue), R (red), G (green) and B (blue)". Also in the fifth embodiment, the light of the same color is emitted plural times within the same frame. As explained previously in conjunction with the embodiment 1, the light emission period individually expressed in a rectangular shape is constituted of eight independent light emission periods where the light emission period is weighted for every bit in an actual operation.

Such sub frame constitution is devised based on the following observations.

1. One frame is constituted of six sub frames in total consisting of the sub frames of R (red) light emission, the sub frames of G (green) light emission and the sub frames of B (blue) light emission. This is because when the number of sub frames is excessively increased, writing frequency of signal data becomes large so that signal writing power consumption is excessively increased.

2. With respect to the sub frame of G (green), the light emission order is made same in the respective frames. This is because G (green) largely influences a sense of vision as a brightness signal and hence, when the light emission order of the sub frame of G (green) changes among the frames, the motion of an object displayed on a screen is not smooth.

3. With respect to the first sub frame, the R (red) light emission and the B (blue) light emission are generated in the first frame and the second frame respectively and alternately, and with respect to the second sub frame, the G (green) light emission is generated in the first frame and the second frame. This is because, due to such a light emission order, the R (red) light emission and the B (blue) light emission generated in the first sub frame are suitably mixed with the next G (green) light emission also in a moving image so that the light emission can be made approximately achromatic.

4. With respect to the sixth sub frame, the R (red) light emission and the B (blue) light emission are generated in the first frame and the second frame respectively and alternately, and with respect to the fifth sub frame, the G (green) light emission is generated in the first frame and the second frame. This is because, due to such a light emission order, the R (red) light emission and the B (blue) light emission generated in the sixth sub frame are suitably mixed with the next G (green) light emission also in a moving image so that the light emission can be made approximately achromatic. Further, the color decomposition generated in the moving image in the first sub frame and the color decomposition generated in the moving image in the sixth sub frame become the substantially same color and hence, a viewer perceives no discomfort.

5. When the frames are continuously arranged, two sub frames of colors other than the G (green) are interposed between the sub frames of G (green). With respect to two sub frames, one sub frame is formed of the sub frame of R (red) and the other sub frame is formed of the sub frame of B (blue). This is because when two sub frames of same color are arranged continuously, color flickers are extremely increased.

As the sub frame placement which satisfies the above-mentioned five conditions, four arrangements shown in following Table are considered.

TABLE 1

| | first frame | second frame |
|---|---|---|
| placement 1 | R, G, R, B, G, R | B, G, B, R, G, B |
| placement 2 | R, G, R, B, G, R | B, G, R, B, G, B |
| placement 3 | R, G, B, R, G, R | B, G, B, R, G, B |
| placement 4 | R, G, B, R, G, R | B, G, R, B, G, B |

Here, the order of the combination of sub frames in the placement 1 and the order of the combination of sub frames in the placement 4 are set opposite to each other with respect to time, and the order of the combination of sub frames in the placement 2 and the order of the combination of sub frames in the placement 3 are set opposite to each other with respect to time. The light emission order in the fifth embodiment uses the case of the placement 1 in Table 1.

Figure 15A:
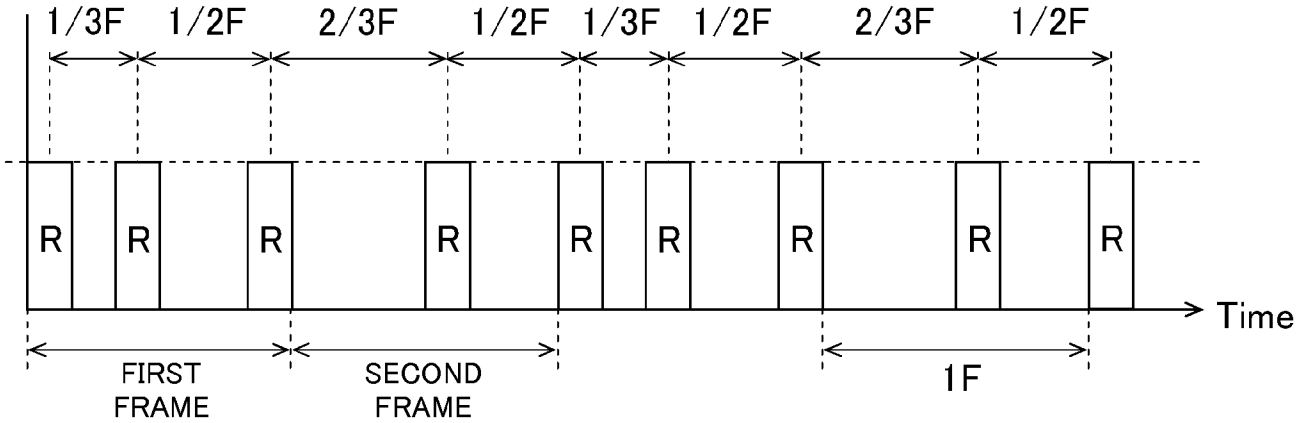
FIG. 15A is a lighting timing chart of the R (red) light source in the fifth embodiment.

FIG. 15A is a lighting timing chart relating to an R (red) light source in the fifth embodiment. As shown in FIG. 15A, a time interval between a light emission center of the first R (red) light emission in the first frame and a light emission center of the second R (red) light emission in the first frame is 1/3 (F). In the same manner, a time interval between the light emission center of the second R (red) light emission in the first frame and a light emission center of the third R (red) light emission in the first frame is 1/2 (F), a time interval between the light emission center of the third R (red) light emission in the first frame and a light emission center of the R (red) light emission in a second frame is 2/3 (F), and a time interval between the light emission center of the R (red) light emission in the second frame and a light emission center of the first R (red) light emission in the next first frame is 1/2 (F). The subsequent time intervals are also substantially equal to the above-mentioned time intervals.

Figure 15B:
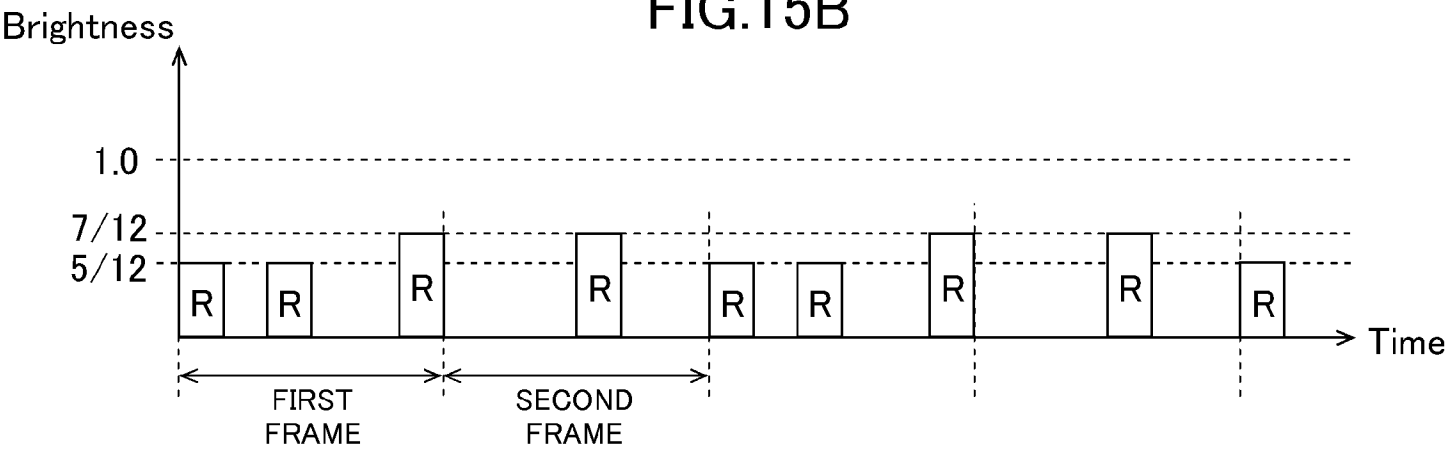
FIG. 15B is a light emission brightness timing chart of the R (red) light source in the fifth embodiment.

FIG. 15B is a light emission brightness timing chart relating to the R (red) light source in the fifth embodiment. For example, with respect to light emission intervals before and after the second R (red) light emission in the first frame, the time interval between the light emission centers before the R (red) light emission is 1/3 (F), and the time interval between the light emission centers after the R (red) light emission is 1/2 (F) and hence, a weighting coefficient is obtained as 5/12 which is 1/2 (average) of a sum of both time intervals. In the same manner, light emission intervals before and after the third R (red) light emission in the first frame are 1/2 (F) and 2/3 (F) respectively and hence, a weighting coefficient is obtained as 7/12 which is 1/2 (average) of a sum of both light emission intervals. The light emission brightnesses in FIG. 15B are obtained by setting the light emission intervals obtained in this manner hereinafter as the weighting coefficients with respect to the respective light emissions. Due to such processing, with respect to the light emission brightness of the R (red) light emission in each light emission period, the light emission brightness of the first R (red) light emission in the first frame is weighted by 5/12, the light emission brightness of the second R (red) light emission in the first frame is weighted by 5/12, the light emission brightness of the third R (red) light emission in the first frame is weighted by 7/12, and the light emission brightness of the R (red) light emission in the second frame is weighted by 7/12.

Figure 16A:
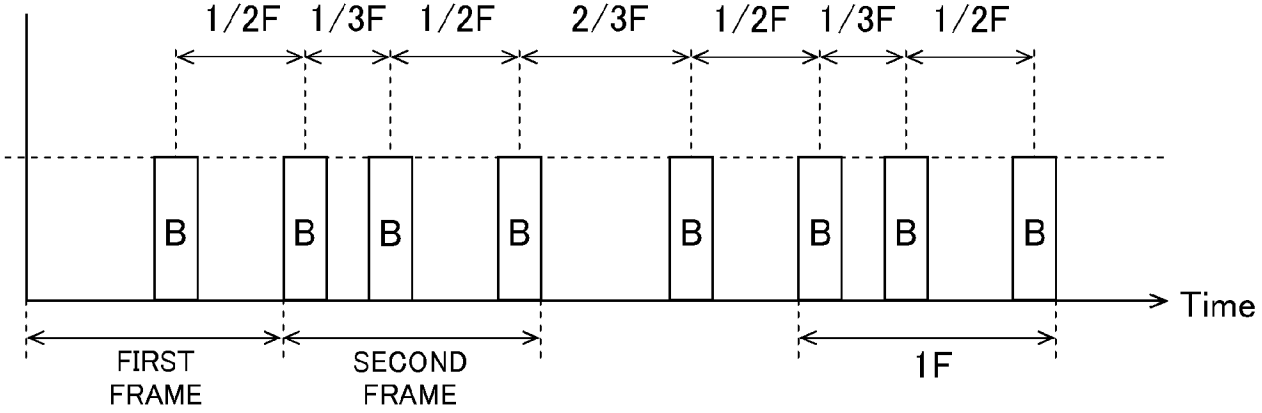
FIG. 16A is a lighting timing chart of a B (blue) light source in the fifth embodiment.

FIG. 16A is a lighting timing chart relating to a B (blue) light source in the fifth embodiment. As shown in FIG. 16A, a time interval between a light emission center of the B (blue) light emission in the first frame and a light emission center of the first B (blue) light emission in the second frame is 1/2 (F). In the same manner, a time interval between the light emission center of the first B (blue) light emission in the second frame and a light emission center of the second B (blue) light emission in the second frame is 1/3 (F), a time interval between the light emission center of the second B (blue) light emission in the second frame and a light emission center of the third B (blue) light emission in the second frame is 1/2 (F), and a time interval between the light emission center of the third B (blue) light emission in the second frame and a light emission center of the B (blue) light emission in the next first frame is 2/3 (F). The subsequent time intervals are also substantially equal to the above-mentioned time intervals.

Figure 16B:
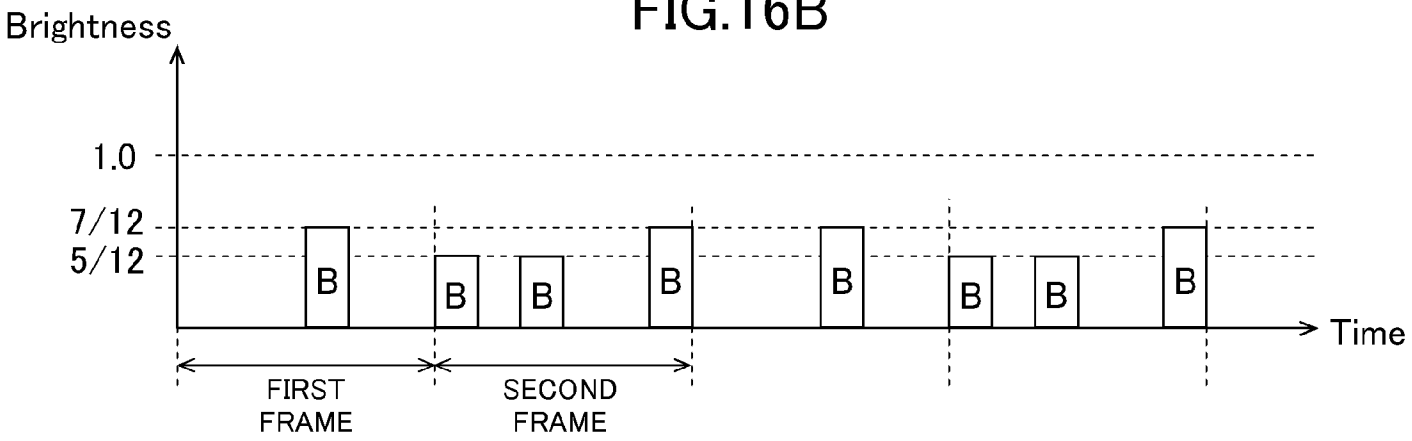
FIG. 16B is a light emission brightness timing chart of the B (blue) light source in the fifth embodiment.

FIG. 16B is a light emission brightness timing chart relating to the B (blue) light source in the fifth embodiment. For example, with respect to light emission intervals before and after the first B (blue) light emission in the second frame, the time interval between the light emission centers before the B (blue) light emission is 1/2 (F), and the time interval between the light emission centers after the B (blue) light emission is 1/3 (F) and hence, a weighting coefficient is obtained as 5/12 which is 1/2 (average) of a sum of both time intervals. In the same manner, light emission intervals before and after the third B (blue) light emission in the second frame are 1/2 (F) and 2/3 (F) respectively and hence, a weighting coefficient is obtained as 7/12 which is 1/2 (average) of a sum of both light emission intervals. The light emission brightnesses in FIG. 16B are obtained by setting the light emission intervals obtained in this manner hereinafter as the weighting coefficients with respect to the respective light emissions. Due to such processing, with respect to the light emission brightness of the B (blue) light emission in each light emission period, the light emission brightness of the B (blue) light emission in the first frame is weighted by 7/12, the light emission brightness of the first B (blue) light emission in the second frame is weighted by 5/12, the light emission brightness of the second B (blue) light emission in the second frame is weighted by 5/12, and the light emission brightness of the third B (blue) light emission in the second frame is weighted by 7/12.

Figure 17:
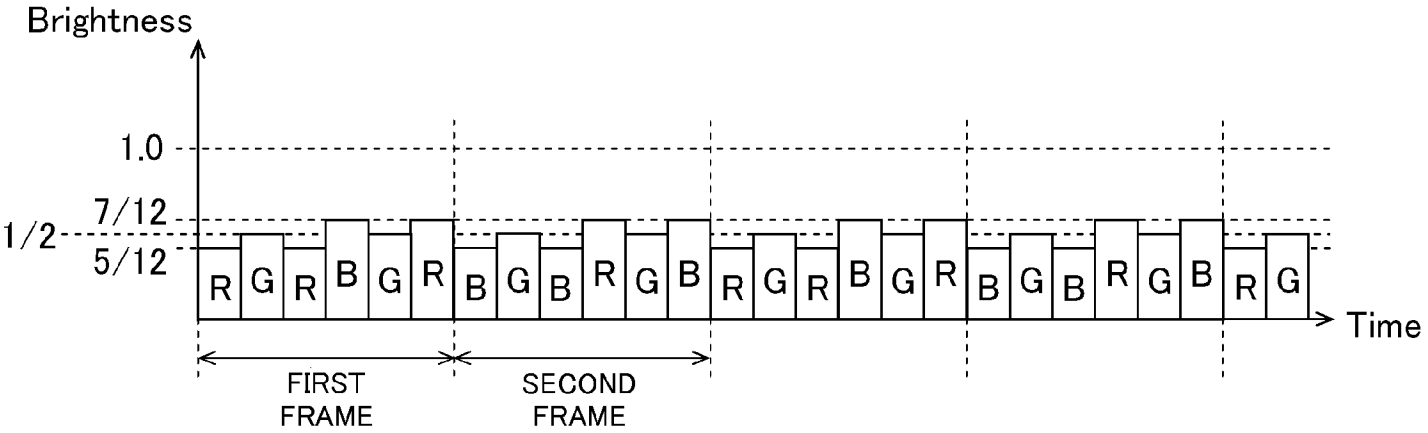
FIG. 17 is a light emission brightness timing chart of R (red), G (green) and B (blue) light sources in the fifth embodiment.

FIG. 17 is a light emission brightness timing chart relating to light sources of three colors of R (red), G (green) and B (blue) obtained in this manner. The G (green) light source emits light at the same timing among respective frames and hence, it is unnecessary to weight the light emission brightness of the G (green) light emission particularly. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit. In this embodiment, it is possible to acquire advantageous effects described in the conditions 1 to 5 described previously including an advantageous effect of suppressing the color decomposition with respect to a moving image.

This embodiment is characterized in that with respect to the G (green) light emission which is generated in respective frames always at the same timing, the time intervals between the light emission centers are all equal and hence, weighting is not applied to the light emission amounts.

As described previously, the light emission order in this embodiment is the case of the placement 1 among four sub frame arrangements in above-mentioned Table 1. Here, the case of the placement 4 is symmetrical with the case of the placement 1 with time. Accordingly, even when the case of the placement 4 is selected, the weighting substantially equal to the weighting of this embodiment is applicable to the case of the placement 4.

Sixth Embodiment

The system constitution of an image display device, the constitution of a display panel and the constitution of a pixel according to the sixth embodiment are substantially equal to the corresponding constitutions according to the above-mentioned first embodiment and hence, the explanation of these constitutions is omitted.

Figure 18:
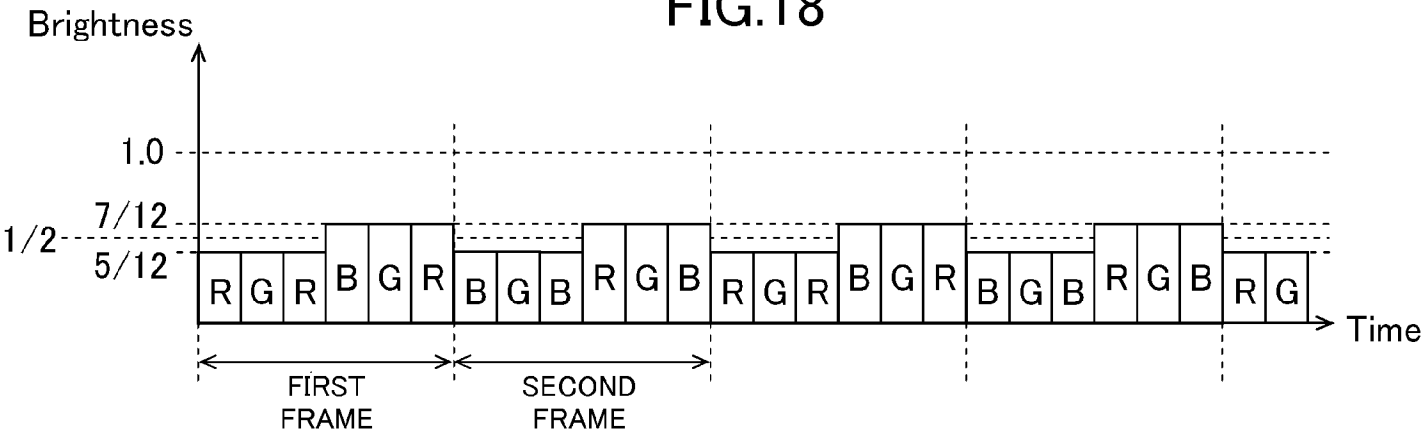
FIG. 18 is a light emission brightness timing chart of R (red), G (green) and B (blue) light sources in a sixth embodiment.

FIG. 18 is a light emission brightness timing chart relating to light sources of three colors of R (red), G (green) and B (blue) in the sixth embodiment. The basic light emission order, the weighting of the light emission brightnesses of light sources of R (red) and B (blue) and advantageous effects obtained by such light emission order and the weighting are substantially equal to those of the above-mentioned fifth embodiment explained in conjunction with FIG. 17 and hence, the explanation of these matters is omitted here.

The constitution which makes the sixth embodiment different from the fifth embodiment when compared lies in that the weighting of the light emission brightness is made with respect to the G (green) light emission particularly in view of a novel purpose. As explained in conjunction with the fifth embodiment, the G (green) light emission is performed at the same timing in respective frames and hence, the weighting is not performed particularly. However, in FIG. 17, as a byproduct which is caused by the suppression of color flickers to achieve the purpose of the present invention, in a front half of each frame, the relative brightness of the G (green) light emission is increased relative to the R (red) light emission and the B (blue) light emission, and in a latter half of each frame, the relative brightness of the G (green) light emission is lowered relative to the R (red) light emission and the B (blue) light emission. Accordingly, there exists a possibility that a color decomposition component is slightly generated such that the color decomposition component is generated slightly close to MG (magenta) in a front portion of a moving image and slightly close to G (green) in a rear portion of the moving image. Although the generation of a slight amount of G (green) flicker component is allowable, depending on a use purpose, there may be a case where it is necessary to avoid such color decomposition with priority. The sixth embodiment is directed to an image display device where the improvement is made for satisfying such a usage.

In the sixth embodiment, the relative brightness of the G (green) light emission is adjusted in the front half and the latter half of each frame such that the G (green) light emission becomes equal to the R (red) light emission and the B (blue) light emission. That is, brightness weighting values of three sub frames in the front half of each frame are unified to 5/12, and brightness weighting values of three sub frames in the latter half of each frame are unified to 7/12. Due to such weighting, in this embodiment, an extremely slight amount of a G (green) flicker component is generated rather than decreasing such a component. However, instead, it is possible to eliminate the color decomposition component which is the byproduct generated in the fifth embodiment and is generated slightly close to MG (magenta) in a front portion of a moving image and slightly close to G (green) in a rear portion of the moving image. The selection of either one of the fifth embodiment and the sixth embodiment or the selection of a value between both embodiments may be performed or adjusted depending on a usage.

Seventh Embodiment

The system constitution of an image display device, the constitution of a display panel and the constitution of a pixel according to the seventh embodiment are substantially equal to the corresponding constitutions according to the above-mentioned first embodiment and hence, the explanation of these constitutions is omitted. Further, the light emission order in the seventh embodiment is equal to the case of the placement 1 shown in Table 1 where the light emission order in the fifth embodiment is described and hence, the explanation with respect to the light emission order is omitted here.

Figure 19A:
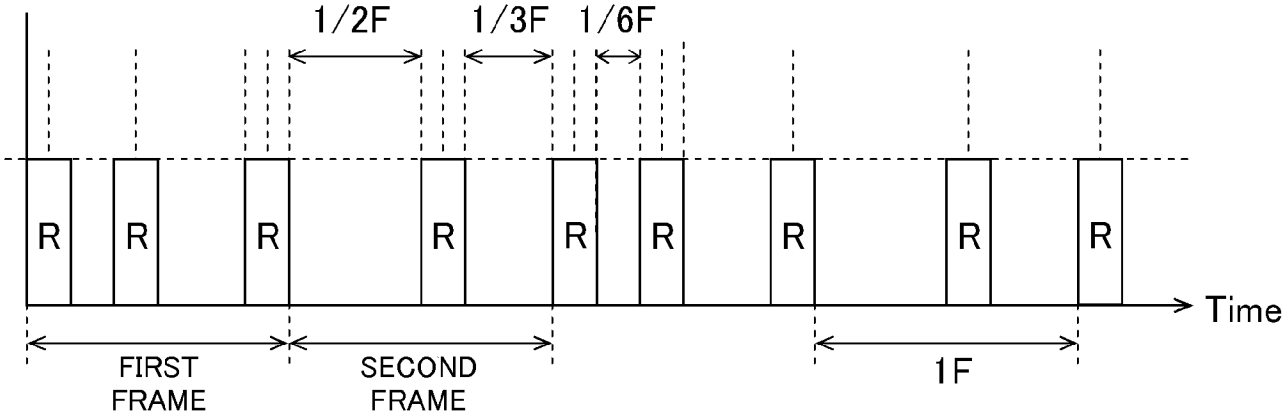
FIG. 19A is a lighting timing chart of an R (red) light source in a seventh embodiment.

FIG. 19A is a lighting timing chart relating to an R (red) light source in the seventh embodiment. As shown in FIG. 19A, a time interval of a non-light emission period between the third R (red) light emission in a first frame and the R (red) light emission in a second frame is 1/2 (F). In the same manner, a time interval of the non-light emission period between the R (red) light emission in the second frame and the first R (red) light emission in the first frame is 1/3 (F), and the time interval of the non-light emission period between the first R (red) light emission in the first frame and the second R (red) light emission in the first frame is 1/6 (F). The subsequent time intervals are also substantially equal to the above-mentioned time intervals.

Figure 19B:
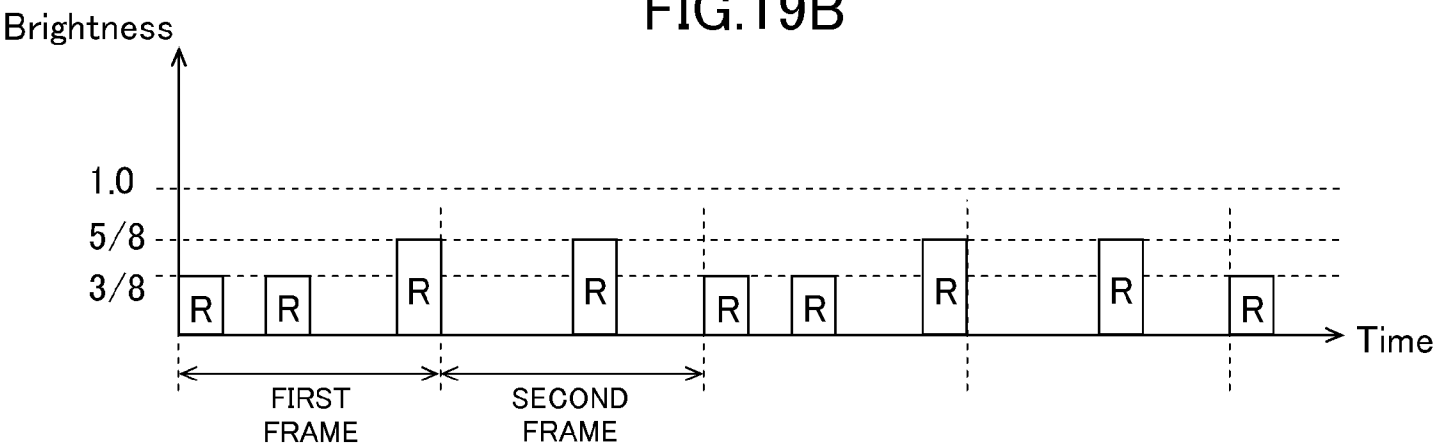
FIG. 19B is a light emission brightness timing chart of the R (red) light source in the seventh embodiment.

FIG. 19B is a light emission brightness timing chart relating to the R (red) light source in the seventh embodiment. Here, the light emission brightness of each color is weighted based on a time for calculation defined by a sum of the time intervals of the non-light emission period between the sub frame and sub frames before and after the sub frame in which light of the same color as the sub frame is emitted such that the total light emission amount within the continuous 2 (F) is not changed. To be more specific, with respect to light emission intervals before and after the R (red) light emission in the second frame, the time interval of the non-light emission period before the R (red) light emission is 1/2 (F), and the time interval of the non-light emission period after the R (red) light emission is 1/3 (F) and hence, a weighting coefficient is 5/8 which is obtained by multiplying a sum of both time intervals of the non-light emission periods by 3/4. In the same manner, light emission intervals before and after the first R (red) light emission in the first frame are 4/12 (F) and 2/12 (F) respectively and hence, a weighting coefficient is 3/8 which is obtained by multiplying a sum of both light emission intervals by 3/4. The light emission brightnesses in FIG. 19B are obtained by setting the light emission intervals obtained in this manner as the weighting coefficients with respect to the respective light emissions. Due to such processing, with respect to the light emission brightness of R (red) in each light emission period, the light emission brightness of the first R (red) light emission in the first frame is weighted by 3/8, the light emission brightness of the second R (red) light emission in the first frame is weighted by 3/8, the light emission brightness of the third R (red) light emission in the first frame is weighted by 5/8, and the light emission brightness of the R (red) light emission in the second frame is weighted by 5/8.

Figure 20A:
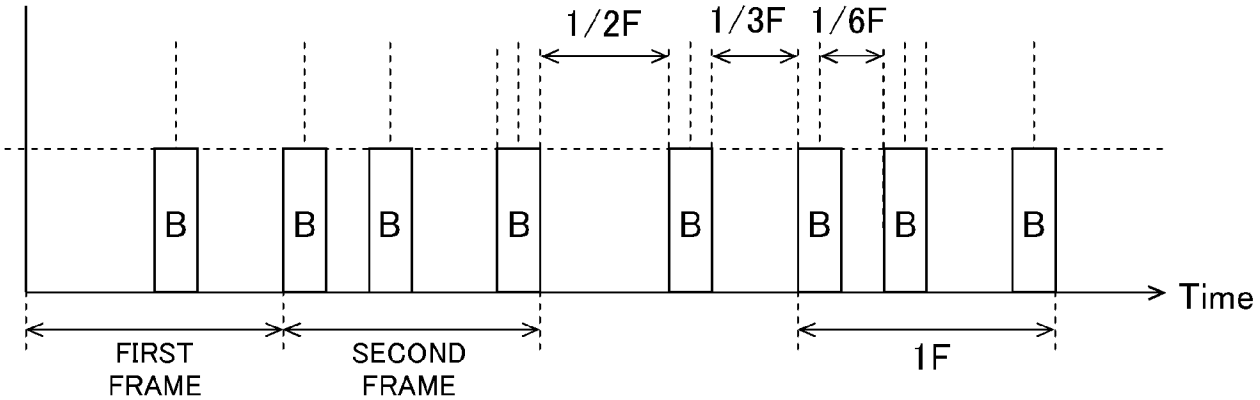
FIG. 20A is a lighting timing chart of a B (blue) light source in the seventh embodiment.

FIG. 20A is a lighting timing chart relating to a B (blue) light source in the seventh embodiment. As shown in FIG. 20A, a time interval of a non-light emission period between the third B (blue) light emission in the second frame and the B (blue) light emission in the first frame is 1/2 (F). In the same manner, a time interval of a non-light emission period between the B (blue) light emission in the first frame and the first B (blue) light emission in the second frame is 1/3 (F), and a time interval of a non-light emission period between the first B (blue) light emission in the second frame and the second B (blue) light emission in the second frame is 1/6 (F). The subsequent time intervals are also substantially equal to the above-mentioned time intervals.

Figure 20B:
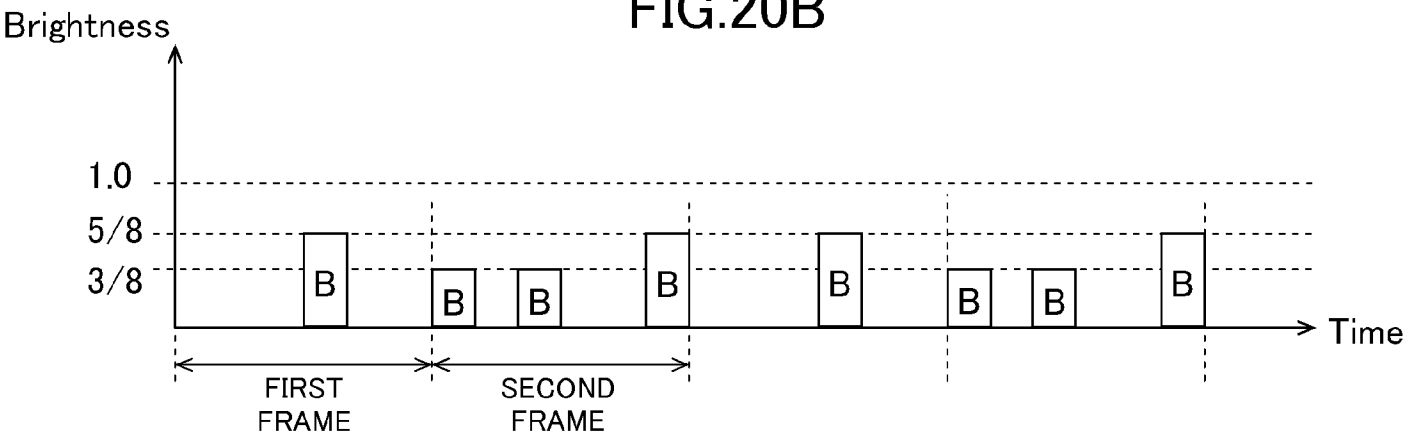
FIG. 20B is a light emission brightness timing chart of the B (blue) light source in the seventh embodiment.

FIG. 20B is a light emission brightness timing chart relating to the B (blue) light source in the seventh embodiment. For example, with respect to light emission intervals before and after the B (blue) light emission in the first frame, the time interval of the non-light emission period before the B (blue) light emission is 1/2 (F), and the time interval of the non-light emission period after the B (blue) light emission is 1/3 (F) and hence, a weighting coefficient is 5/8 which is obtained by multiplying a sum of both time intervals of the non-light emission periods by 3/4. In the same manner, light emission intervals before and after the first B (blue) light emission in the second frame are 1/3 (F) and 1/6 (F) respectively and hence, a weighting coefficient is 3/8 which is obtained by multiplying a sum of both light emission intervals by 3/4. The light emission brightnesses in FIG. 20B are obtained by setting the light emission intervals obtained in this manner as the weighting coefficients with respect to the respective light emissions. Due to such processing, with respect to the light emission brightness of B (blue) in each light emission period, the light emission brightness of the B (blue) light emission in the first frame is weighted by 5/8, the light emission brightness of the first B (blue) light emission in the second frame is weighted by 3/8, the light emission brightness of the second B (blue) light emission in the second frame is weighted by 3/8, and the light emission brightness of the third B (blue) light emission in the second frame is weighted by 5/8.

Figure 21:
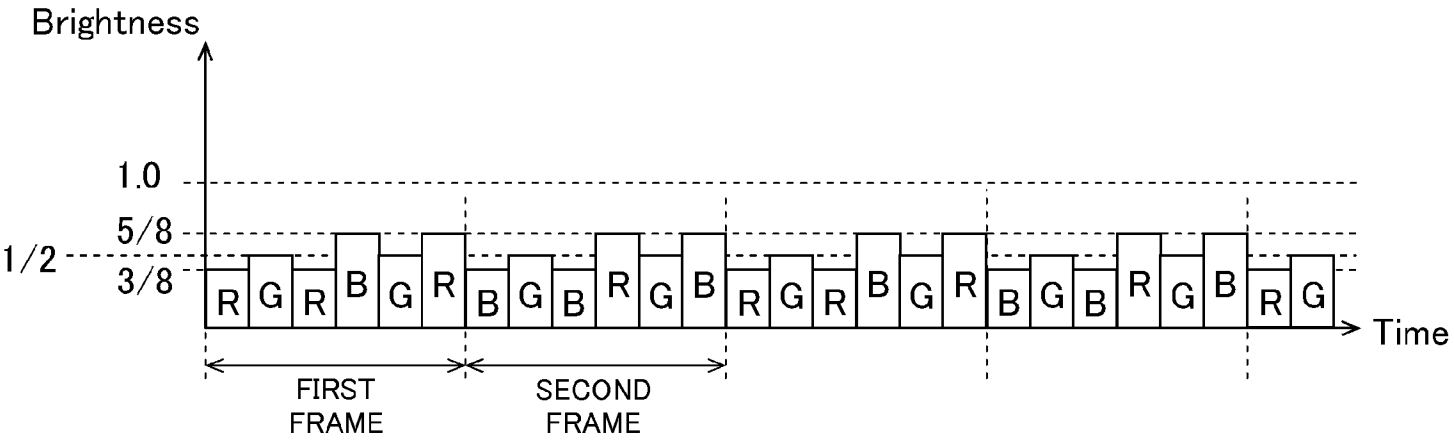
FIG. 21 is a light emission brightness timing chart of R (red), G (green) and B (blue) light sources in the seventh embodiment.

FIG. 21 is a light emission brightness timing chart relating to light sources of three colors of R (red), G (green) and B (blue) obtained in this manner. The G (green) light source emits light at the same timing among respective frames and hence, it is unnecessary to weight the light emission brightness of the G (green) light emission. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit.

This embodiment can acquire the advantageous effects described in the conditions 1 to 5 described previously including an advantageous effect of suppressing the color decomposition with respect to a moving image.

This embodiment is characterized in that with respect to the G (green) light emission which is generated in respective frames always at the same timing, the time intervals between the light emission centers are all equal and hence, weighting is not applied to the light emission amounts.

The difference between the weighting coefficient used in the fifth embodiment and the weighting coefficient used in the seventh embodiment is substantially equal to the difference previously described in the explanation in conjunction with the second embodiment. That is, the former is a technique suitable for a high brightness display gray level region particularly while the latter is a technique suitable for a low-brightness display gray level region particularly. Accordingly, it is preferable to properly use the weighting coefficient used in the fifth embodiment and the weighting coefficient used in the seventh embodiment separately between a high brightness portion and a low brightness portion in an image. However, from a viewpoint of simplifying the system practically, it is desirable to select either one of these weighting coefficients or to fix the weighting coefficient to a proper value between both weighting coefficients by taking into account a display image quality in general.

As described previously, the light emission order in this seventh embodiment is the case of the placement 1 among four sub frame arrangements in above-mentioned Table 1. Here, the case of the placement 4 is symmetrical with the case of the placement 1 with time. Accordingly, even when the case of the placement 4 is selected, the weighting substantially equal to the weighting of this embodiment is applicable to the case of the placement 4.

Eighth Embodiment

The system constitution of an image display device, the constitution of a display panel and the constitution of a pixel according to the eighth embodiment are substantially equal to the corresponding constitutions according to the above-mentioned first embodiment and hence, the explanation of these constitutions is omitted.

Figure 22:
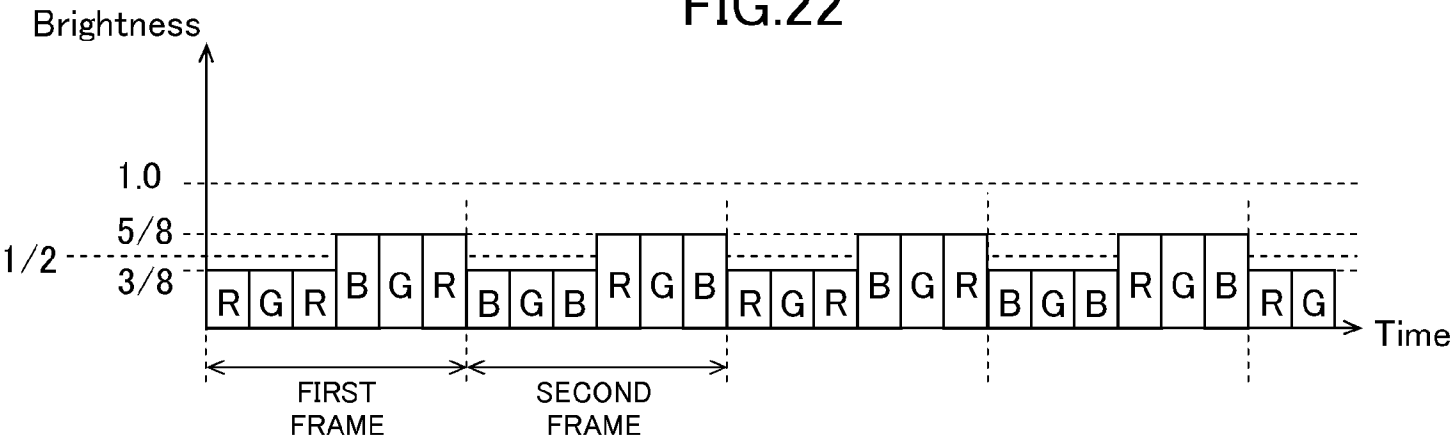
FIG. 22 is a light emission brightness timing chart of R (red), G (green) and B (blue) light sources in an eighth embodiment.

FIG. 22 is a light emission brightness timing chart relating to light sources of three colors of R (red), G (green) and B (blue) in the sixth embodiment. The basic light emission order, the weighting of the light emission brightnesses of light sources of R (red) and B (blue) and advantageous effects obtained by such light emission order and the weighting are substantially equal to those of the above-mentioned seventh embodiment explained in conjunction with FIG. 21 and hence, the explanation of these matters is omitted here.

The constitution which makes the eighth embodiment differ from the seventh embodiment when compared lies in that the weighting of the light emission brightness is made with respect to the G (green) light emission particularly in view of a novel purpose. As explained in conjunction with the seventh embodiment, the G (green) light emission is performed at the same timing in respective frames and hence, the weighting is not performed particularly. However, in FIG. 21, as a byproduct which is caused by the suppression of color flickers to achieve the purpose of the present invention, in a front half of each frame, the relative brightness of the G (green) light emission is increased relative to the R (red) light emission and the B (blue) light emission, and in a latter half of each frame, the relative brightness of the G (green) light emission is lowered relative to the R (red) light emission and the B (blue) light emission. Accordingly, there exists a possibility that a color decomposition component is slightly generated such that the color decomposition component is generated slightly close to MG (magenta) in a front portion of a moving image and slightly close to G (green) in a rear portion of the moving image. Although the generation of a slight amount of G (green) flicker component is allowable, depending on a use purpose, there may be a case where it is necessary to avoid such color decomposition with priority. The eighth embodiment is directed to an image display device where the improvement is made for satisfying such a usage.

In the eighth embodiment, the relative brightness of the G (green) light emission is adjusted in the front half and the latter half of each frame such that the G (green) light emission becomes equal to the R (red) light emission and the B (blue) light emission. That is, brightness weighting values of three sub frames in the front half of each frame are unified to 3/8, and brightness weighting values of three sub frames in the latter half of each frame are unified to 5/8. Due to such weighting, in this eighth embodiment, an extremely slight amount of a G (green) flicker component is generated rather than decreasing such a component. However, instead, it is possible to eliminate the color decomposition component which is the byproduct generated in the seventh embodiment and is generated slightly close to MG (magenta) in a front portion of a moving image and slightly close to G (green) in a rear portion of the moving image. The selection of either one of the seventh embodiment and the eighth embodiment or the selection of a value between both embodiments may be performed or adjusted depending on a usage.

Ninth Embodiment

The system constitution of an image display device, the constitution of a display panel and the constitution of a pixel according to the ninth embodiment are substantially equal to the corresponding constitutions according to the above-mentioned first embodiment and hence, the explanation of these constitutions is omitted.

Figure 23:
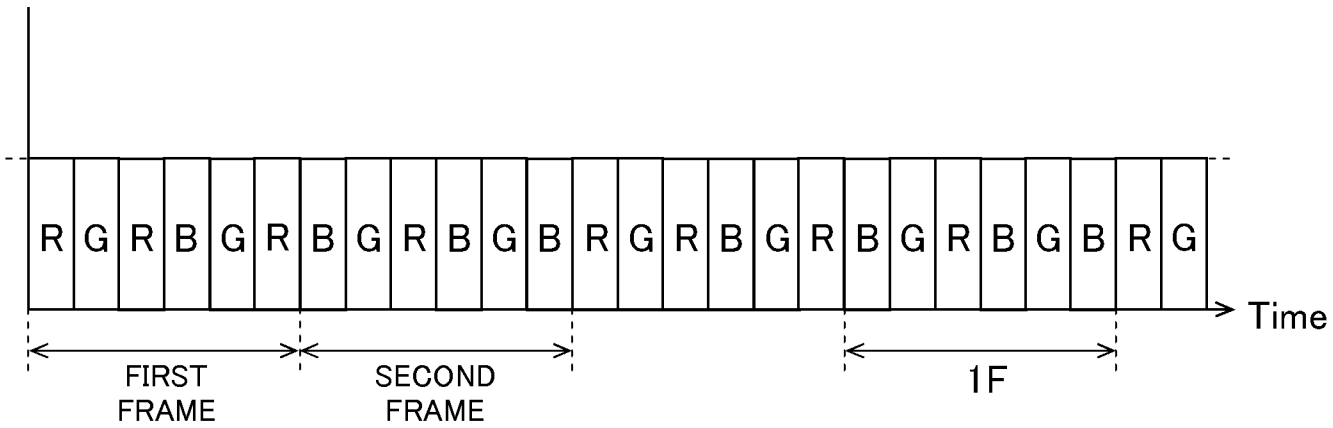
FIG. 23 is a lighting timing chart of R (red), G (green) and B (blue) light sources in a ninth embodiment.

FIG. 23 shows a lighting timing chart according to the ninth embodiment which is devised this time to cope with the color decomposition in a field sequential display. To be more specific, a first frame is constituted of six sub frames of "R (red), G (green), R (red), B (blue), G (green) and R (red)", and a second frame is constituted of six sub frames of "B (blue), G (green), R (red), B (blue), G (green) and B (blue)". This constitution order of the sub frames corresponds to the case of the placement 2 previously explained in conjunction with the fifth embodiment.

Figure 24A:
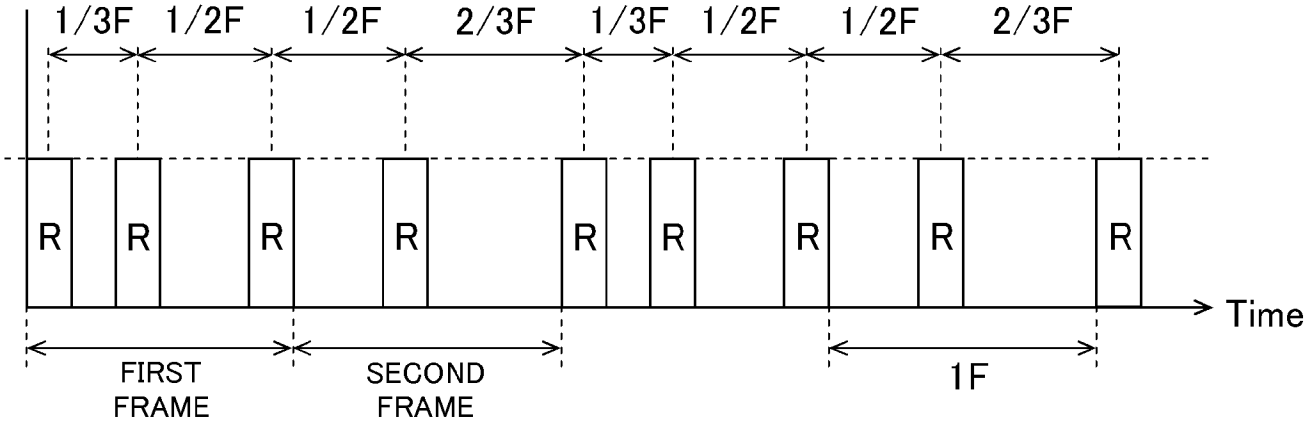
FIG. 24A is a lighting timing chart of the R (red) light source in the ninth embodiment.

FIG. 24A is a lighting timing chart relating to an R (red) light source in the ninth embodiment. As shown in FIG. 24A, a time interval between a light emission center of the first R (red) light emission in the first frame and a light emission center of the second R (red) light emission in the first frame is 1/3 (F). In the same manner, a time interval between the light emission center of the second R (red) light emission in the first frame and a light emission center of the third R (red) light emission in the first frame is 1/2 (F), a time interval between the light emission center of the third R (red) light emission in the first frame and a light emission center of the R (red) light emission in a second frame is 1/2 (F), and a time interval between the light emission center of the R (red) light emission in the second frame and a light emission center of the first R (red) light emission in the next first frame is 2/3 (F). The subsequent time intervals are also substantially equal to the above-mentioned time intervals.

Figure 24B:
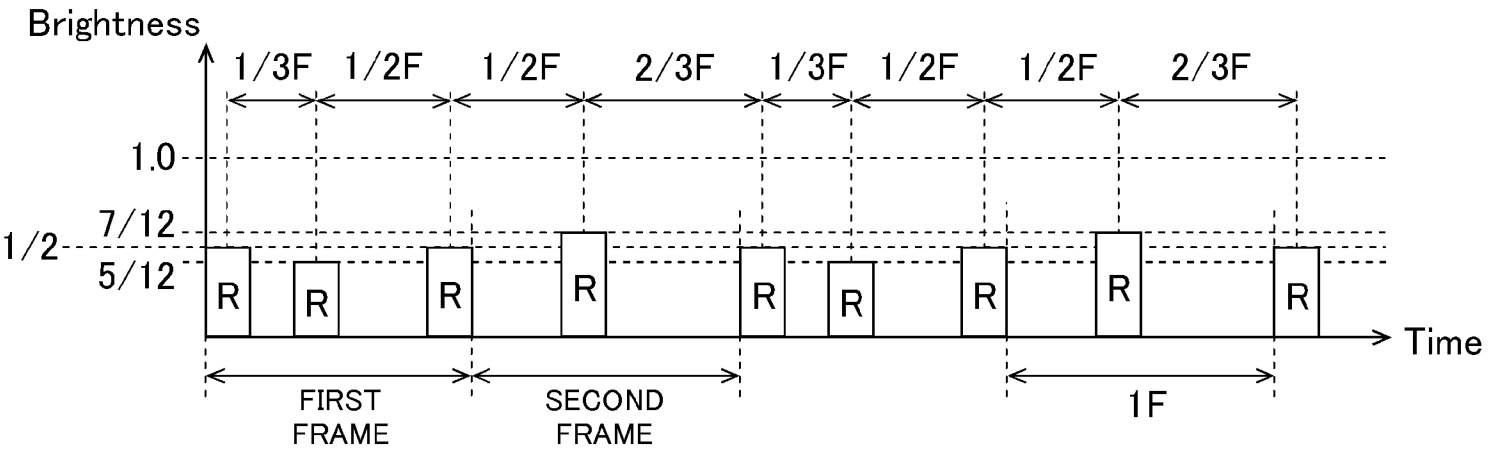
FIG. 24B is a light emission brightness timing chart of the R (red) light source in the ninth embodiment.

FIG. 24B is a light emission brightness timing chart relating to the R (red) light source in the ninth embodiment. For example, with respect to light emission intervals before and after the second R (red) light emission in the first frame, the time interval between the light emission centers before the second R (red) light emission is 1/3 (F), and the time interval between the light emission centers after the second R (red) light emission is 1/2 (F) and hence, a weighting coefficient is 5/12 which is obtained by multiplying a sum of both time intervals by 1/2. In the same manner, light emission intervals before and after the third R (red) light emission in the first frame are 1/2 (F) and 1/2 (F) respectively and hence, a weighting coefficient is 1/2 which is obtained by multiplying a sum of both light emission intervals by 1/2. The light emission brightnesses in FIG. 24B are obtained by setting the light emission intervals obtained in this manner as the weighting coefficients with respect to the respective light emissions. Due to such processing, with respect to the light emission brightness of the R (red) light emission in each light emission period, the light emission brightness of the first R (red) light emission in the first frame is weighted by 1/2, the light emission brightness of the second R (red) light emission in the first frame is weighted by 5/12, the light emission brightness of the third R (red) light emission in the first frame is weighted by 1/2, and the light emission brightness of the R (red) light emission in the second frame is weighted by 7/12.

Figure 25A:
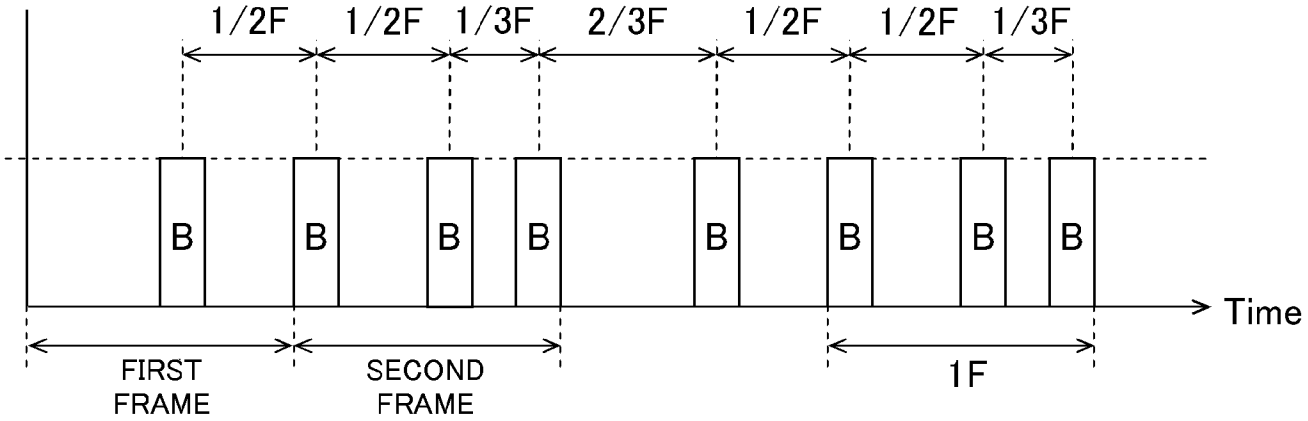
FIG. 25A is a lighting timing chart of the B (blue) light source in the ninth embodiment.

FIG. 25A is a lighting timing chart relating to a B (blue) light source in the ninth embodiment. As shown in FIG. 25A, a time interval between a light emission center of the B (blue) light emission in the first frame and a light emission center of the first B (blue) light emission in the second frame is 1/2 (F). In the same manner, a time interval between the light emission center of the first B (blue) light emission in the second frame and a light emission center of the second B (blue) light emission in the second frame is 1/2 (F), a time interval between the light emission center of the second B (blue) light emission in the second frame and a light emission center of the third B (blue) light emission in the second frame is 1/3 (F), and a time interval between the light emission center of the third B (blue) light emission in the second frame and a light emission center of the B (blue) light emission in the next first frame is 2/3 (F). The subsequent time intervals are also substantially equal to the above-mentioned time intervals.

Figure 25B:
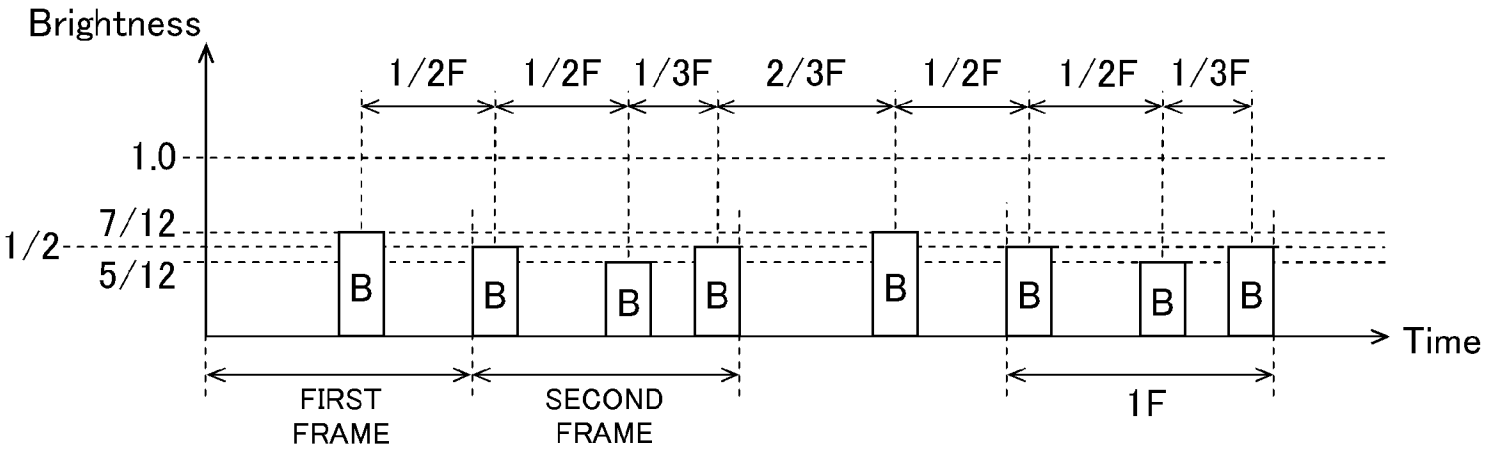
FIG. 25B is a light emission brightness timing chart of the B (blue) light source in the ninth embodiment.

FIG. 25B is a light emission brightness timing chart relating to the B (blue) light source in the ninth embodiment. For example, with respect to light emission intervals before and after the first B (blue) light emission in the second frame, the time interval between the light emission centers before the first B (blue) light emission is 1/2 (F), and the time interval between the light emission centers after the first B (blue) light emission is 1/2 (F) and hence, a weighting coefficient is 1/2 which is obtained by multiplying a sum of both time intervals by 1/2. In the same manner, light emission intervals before and after the second B (blue) light emission in the second frame are 1/2 (F) and 1/3 (F) respectively and hence, a weighting coefficient is 5/12 which is obtained by multiplying a sum of both light emission intervals by 1/2. The light emission brightnesses in FIG. 25B are obtained by setting the light emission intervals obtained in this manner as the weighting coefficients with respect to the respective light emissions. Due to such processing, with respect to the light emission brightness of the B (blue) light emission in each light emission period, the light emission brightness of the B (blue) light emission in the first frame is weighted by 7/12, the light emission brightness of the first B (blue) light emission in the second frame is weighted by 1/2, the light emission brightness of the second B (blue) light emission in the second frame is weighted by 5/12, and the light emission brightness of the third B (blue) light emission in the second frame is weighted by 1/2.

Figure 26:
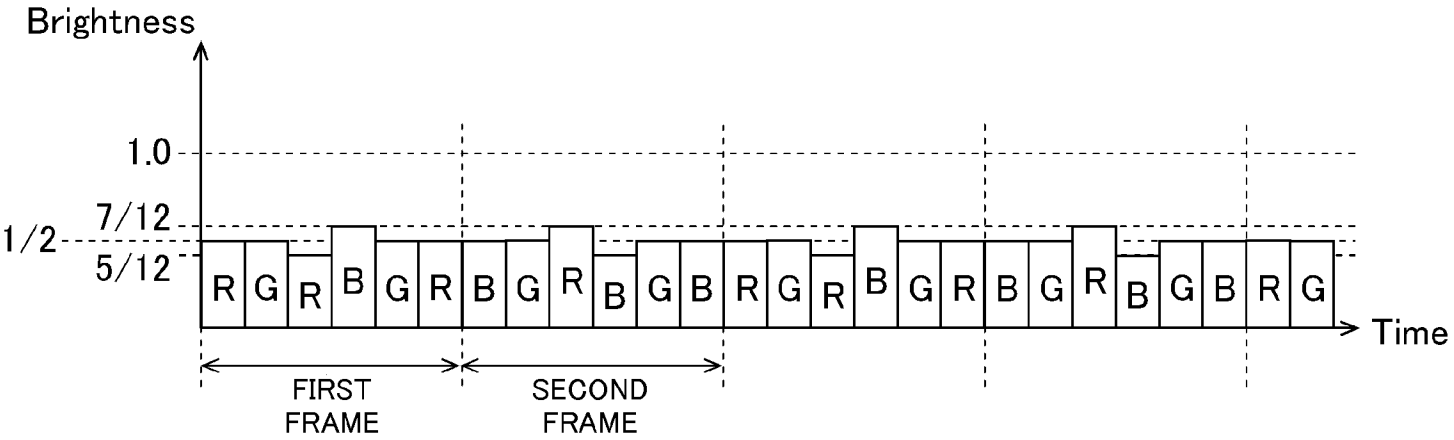
FIG. 26 is a light emission brightness timing chart of R (red), G (green) and B (blue) light sources in the ninth embodiment.

FIG. 26 is a light emission brightness timing chart relating to light sources of three colors of R (red), G (green) and B (blue) obtained in this manner. The G (green) light source emits light at the same timing among respective frames and hence, it is unnecessary to weight the light emission brightness of the G (green) light emission particularly. Although the light emission brightness of each color in each frame differs for every frame, an object which a viewer visually recognizes is not an image in accordance with a frame unit but a series of continuous light emissions and hence, no problem arises particularly. In this embodiment, by applying weighting to the brightness as described above, a light emission component having frequency equal to or below frame frequency can be cancelled so that low frequency flicker noises generated in each light emission color of R (red), G (green) or B (blue) can be lowered to a value equal to or below a perception limit.

This embodiment can acquire advantageous effects described in the conditions 1 to 5 explained in conjunction with the fifth embodiment including the advantageous effect of suppressing the color decomposition with respect to a moving image.

This ninth embodiment is characterized in that with respect to the G (green) light emission which is generated in respective frames always at the same timing, the time intervals between the light emission centers are all equal and hence, weighting is not applied to the light emission amounts.

Further, in the ninth embodiment, the distribution of light emission brightness of three colors of R (red), G (green) and B (blue) is small thus giving rise to an advantageous effect that the ninth embodiment is advantageous for the suppression of color flicker noises compared to the fifth embodiment.

As described previously, the light emission order in this fifth embodiment is the case of the placement 2 among four sub frame arrangements in above-mentioned Table 1. Here, the case of the placement 2 is symmetrical with the case of the placement 3 with time. Accordingly, even when the case of the placement 3 is selected, the weighting substantially equal to the weighting of the ninth embodiment is applicable to the case of the placement 3.

As a modification of the ninth embodiment, a period between the respective light emissions can be used as time interval of a non-light emission period in place of time intervals between the respective light emission centers. Which one of these two time intervals is used is decided in the same manner as the difference in weighting coefficient explained previously in conjunction with the seventh embodiment. That is, the former is a technique suitable for a high brightness display gray level region particularly while the latter is a technique suitable for a low-brightness display gray level region particularly. Accordingly, it is preferable to properly use the former and the latter separately between a high brightness portion and a low brightness portion in an image. However, from a viewpoint of simplifying the system practically, it is desirable to select either one of these time intervals or to fix the time interval to a proper value between both time intervals by taking into account a display image quality in general.

Tenth Embodiment

The system constitution of an image display device, the constitution of a display panel and the constitution of a pixel according to the tenth embodiment are substantially equal to the corresponding constitutions according to the above-mentioned first embodiment and hence, the explanation of these constitutions is omitted. Further, a color control method adopted by the tenth embodiment is as same as the color control method adopted by the sixth embodiment and hence, the explanation of the color control method is also omitted. The technical feature of the tenth embodiment, compared with the sixth embodiment, lies in a display operation using digital signals and hence, the explanation is made hereinafter by focusing on this display operation.

Figure 27A:
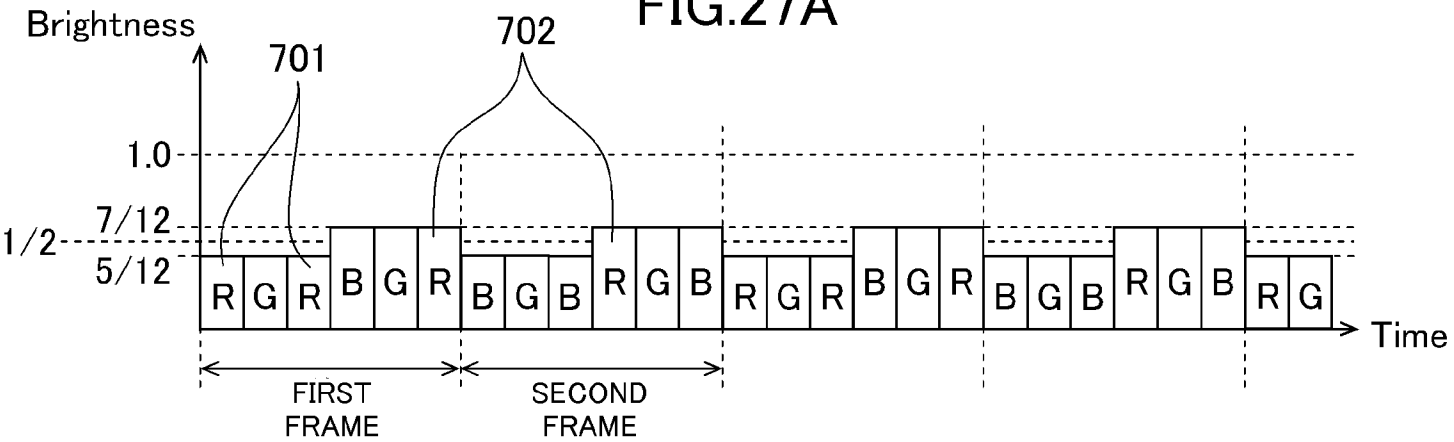
FIG. 27A is a light emission brightness timing chart of R (red), G (green) and B (blue) light sources in a tenth embodiment.

FIG. 27A is a light emission brightness timing chart relating to light sources of three colors of R (red), G (green) and B (blue) in the tenth embodiment. This timing chart is substantially equal to the timing chart shown in FIG. 18 explained in conjunction with the above-mentioned sixth embodiment and hence, the explanation of the timing chart is omitted.

Figure 27B:
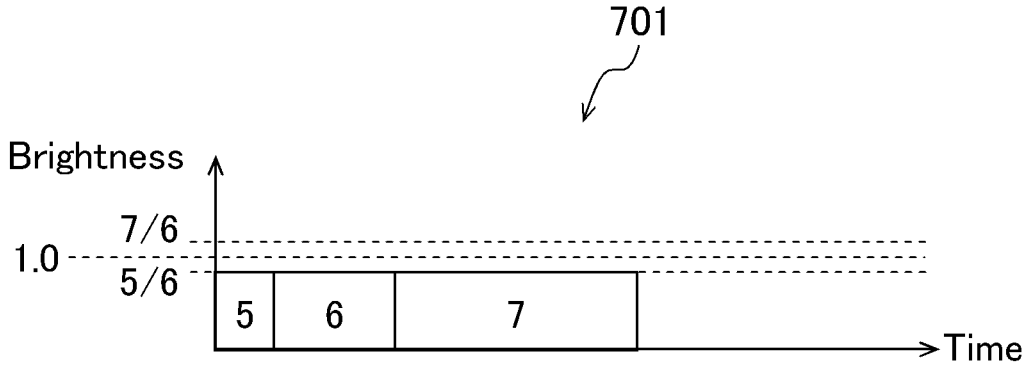
FIG. 27B is a view showing a bit allocation period in a light emission period of R (red) in a front half of a first frame in the tenth embodiment.
Figure 27C:
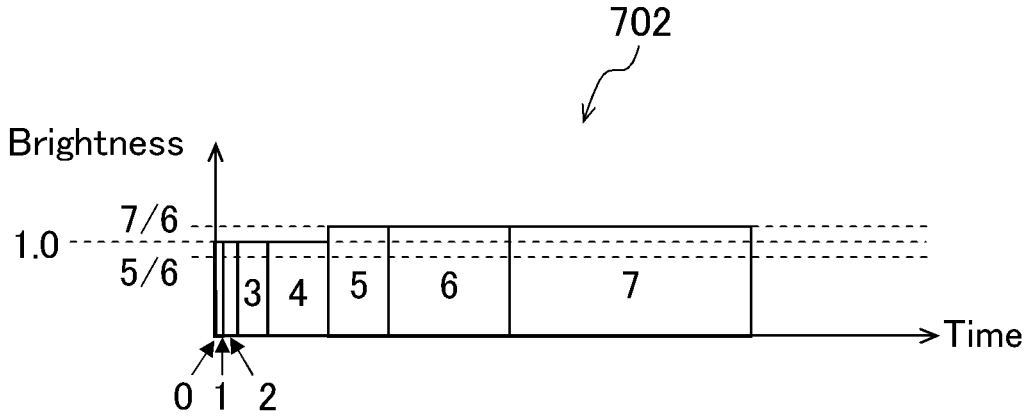
FIG. 27C is a view showing a bit allocation period in the light emission period of R (red) in a latter half of the first frame and a latter half of a second frame in the tenth embodiment.

FIG. 27B is a view showing a bit allocation period in an R (red) light emission period 701 which is an R (red) light emission period in a front half of a first frame in FIG. 27A, and FIG. 27C is a view showing a bit allocation period in an R (red) light emission period 702 which is an R (red) light emission period in a latter half of the first frame and a latter half of a second frame.

A light emission period of individual color described in FIG. 27A is, in the actual constitution, constituted of eight independent light emission periods where the light emission period is weighted for every bit. In this embodiment, the R (red) light emission period 701 is, as shown in FIG. 27B, constituted of three independent light emission periods of 5-bit, 6-bit and 7-bit where the light emission period is weighted for every bit, while the R (red) light emission period 702 is constituted of eight independent light emission periods of 0-bit, 1-bit, 2-bit, 3-bit, 4-bit, 5-bit, 6-bit and 7-bit where the light emission period is weighted for every bit.

While the tenth embodiment can expect advantageous effects substantially equal to the advantageous effects explained in conjunction with the sixth embodiment, the tenth embodiment also possesses a novel advantage that a rectangular light emission waveform in a front half of the frame does not contain 0-bit, 1-bit, 2-bit, 3-bit and 4-bit and hence, the number of times of writing signals to pixels per frame can be reduced. However, it is necessary to pay attention to a fact that weighting is 1.0 with respect to the respective light emission brightnesses of 0-bit, 1-bit, 2-bit, 3-bit and 4-bit which are included in a rectangular light emission waveform in a latter half of the frame at this point of time. Further, with respect to the respective light emission brightnesses of 5-bit, 6-bit and 7-bit included in both front-half and latter-half light emission periods of the frame, aiming at the reduction of the brightness difference between these light emission brightnesses of 5-bit, 6-bit and 7-bit and light emission brightnesses of 0-bit, 1-bit, 2-bit, 3-bit and 4-bit, while maintaining an average value of brightness at 1.0, the light emission period is split in two to a front half of the frame and the latter half of the frame in place of brightness. This is because to ensure a large control range of a light emission current value of an LED which constitutes a backlight light source is a factor which pushes up a cost of control parts. In FIG. 27C, a timewise length of 4-bit and a timewise length of 5-bit are set equal for this reason. Accordingly, although the brightness in the front half of the frame is described as 5/12 and the brightness in the latter half of the frame is described as 7/12 in FIG. 27A, the actual brightnesses of the individual 5-bit, 6-bit and 7-bit described in FIG. 27B and FIG. 27C are set to 5/6 and 7/6 which are values twice as large as the above-mentioned values.

By adopting the concept of weighting of a light emission amount as in the case of the tenth embodiment, it is possible to acquire a novel advantageous effect that the number of times of writing signals to pixels per frame can be reduced.

Although the brightness is mainly used for weighting of a light emission amount also in the tenth embodiment, a light emission period can be also used for weighting of the light emission amount in place of the brightness.

Eleventh Embodiment

A system constitutional view of an image display device according to the eleventh embodiment is substantially equal to the system constitutional view of the above-mentioned first embodiment and hence, the explanation of the system constitution of the image display device according to this embodiment is omitted.

Figure 28:
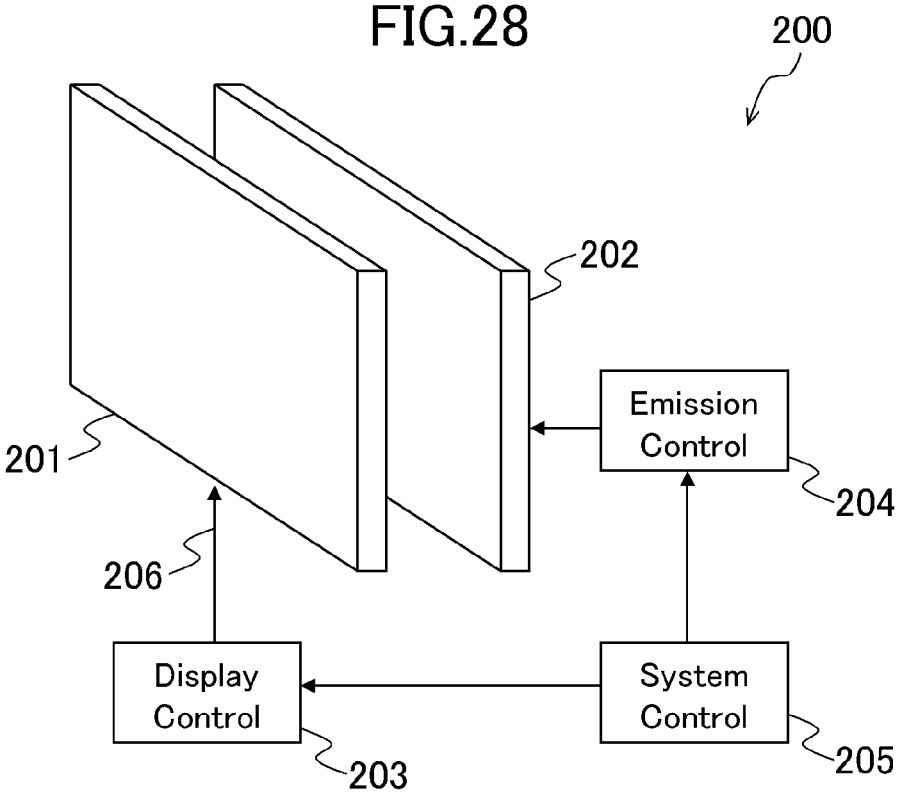
FIG. 28 is a system constitutional view of an image display device according to an eleventh embodiment of the present invention.

FIG. 28 is a system constitutional view of an image display device 200 according to the eleventh embodiment of the present invention. A system control circuit 205 is connected to a display control circuit 203 and a light emission control circuit 204, the system control circuit 205 is connected to a display panel 201 through a panel control line 206, and the light emission control circuit 204 is connected to a backlight light source 202. The system control circuit 205 transmits image data corresponding to a display image and drive timing of the display panel 201 to the display control circuit 203, and transmits timing at which the backlight light source 202 is made to emit light of any one of three colors consisting of R, G and B in synchronism with driving of the display panel 201 to the light emission control circuit 204. Upon receiving these signals, the display control circuit 203 and the light emission control circuit 204 respectively transmit signals necessary for driving the display panel 201 and the backlight light source 202 to the display panel 201 and the backlight light source 202.

Figure 29:
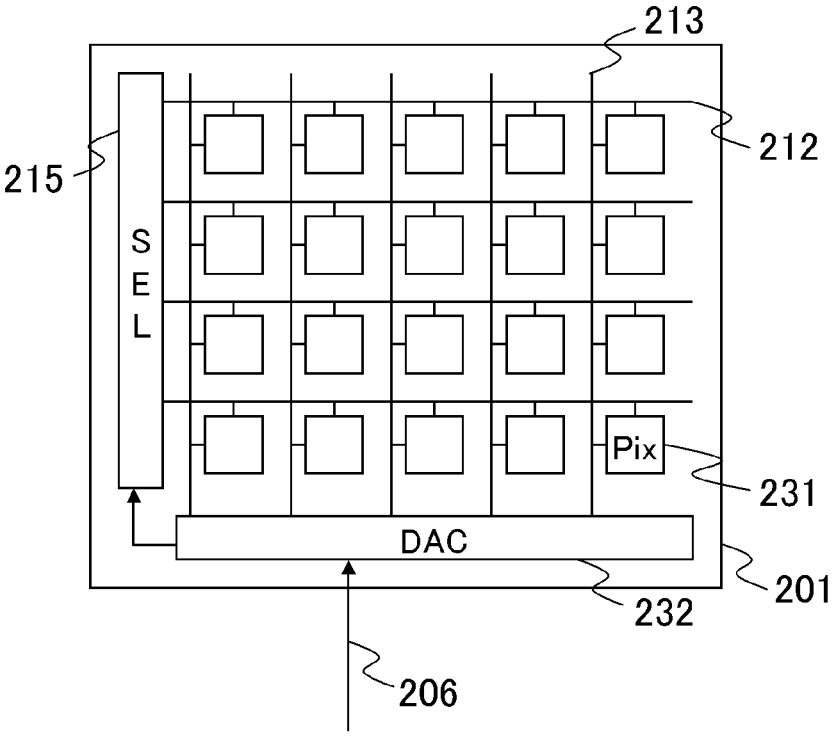
FIG. 29 is a constitutional view of a display panel shown in FIG. 28.

FIG. 29 is a constitutional view of the display panel 201 according to the eleventh embodiment. Pixels 231 are arranged in a display region of the display panel 201 in a matrix array, scanning lines 212 are connected to the pixels 231 in the row direction, and signal lines 213 are connected to the pixels 231 in the columnar direction. A scanning line scanning circuit 215 is connected to one end of each scanning line 212, and one end of each signal line 213 is connected to an analogue signal input circuit 232. The analogue signal input circuit 232 controls the scanning line scanning circuit 215, and a signal is inputted to the analogue signal input circuit 232 through the panel control line 206.

When image data and drive timing are inputted to the display panel 201 through the panel control line 206, the analogue signal input circuit 232 inputs an analogue image signal voltage to the signal lines 213 while controlling the scanning line scanning circuit 215 at predetermined timing. An operation of each pixel 231 is controlled in response to a signal from the scanning line scanning circuit 215 through the scanning line 212, and the analogue image signal voltage is fetched or displayed through the signal line 213 at predetermined timing.

Figure 30:
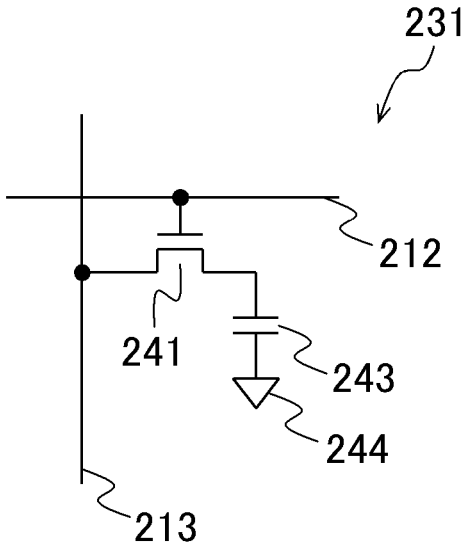
FIG. 30 is a view showing the constitution of a pixel shown in FIG. 29.

FIG. 30 is a constitutional view of the pixel 231. The pixel 231 is constituted of a TFT switch 241 which has a gate thereof connected to the scanning line 212 and has one end of drain/source terminals thereof connected to the signal line 213, and a liquid crystal capacitance element 243 which is provided between the other end of the drain/source terminals of the TFT switch 241 and a common electrode 244.

When the TFT switch 241 of the pixel 231 which the scanning line 212 selects is brought into an ON state, a signal voltage which is analogue image data written in the signal line 213 is written in the liquid crystal capacitance element 243, and this signal voltage is held even after the scanning line 212 brings the TFT switch 241 into an OFF state. The liquid crystal capacitance element 243 controls a light blocking amount with respect to the backlight light source 202 based on an analogue signal voltage written in the liquid crystal capacitance element 243 in an analogue manner. An analogue control of light blocking amount with respect to a backlight light source 202 using the liquid crystal capacitance element 243 is performed by an operational principle substantially equal to an operational principle of a known liquid crystal display and hence, the detailed explanation of the analogue control is omitted.

Here, each pixel 231 does not have a color decomposition means such as a color filter and, in the eleventh embodiment, coloring of the image display device 200 is controlled by a so-called field sequential display method where light emission colors of the backlight light source 202 are sequentially changed. Further, a color control method adopted by the eleventh embodiment is as same as the color control method adopted by the first embodiment explained in conjunction with FIG. 4 and FIG. 5. However, this embodiment differs from the first embodiment such that while each light emission period is constituted of eight independent light emission periods which are weighted for every gray level bit in the actual constitution in the first embodiment, the optical transmissivity is controlled in an analogue manner corresponding to a gray level value by a liquid crystal shutter in the eleventh embodiment.

Also in this embodiment, in the same manner as the first embodiment, by applying weighting to the brightness, a light emission component having frequency equal to or below frame frequency can be cancelled so that low frequency flicker noises generated in each light emission color of R (red), G (green) or B (blue) can be lowered to a value equal to or below a perception limit. In this embodiment, the light emission order of R (red), G (green) and B (blue) is changed for every frame and hence, it is also possible to acquire an advantageous effect of suppressing the color decomposition with respect to a moving image.

Twelfth Embodiment

Figure 31:
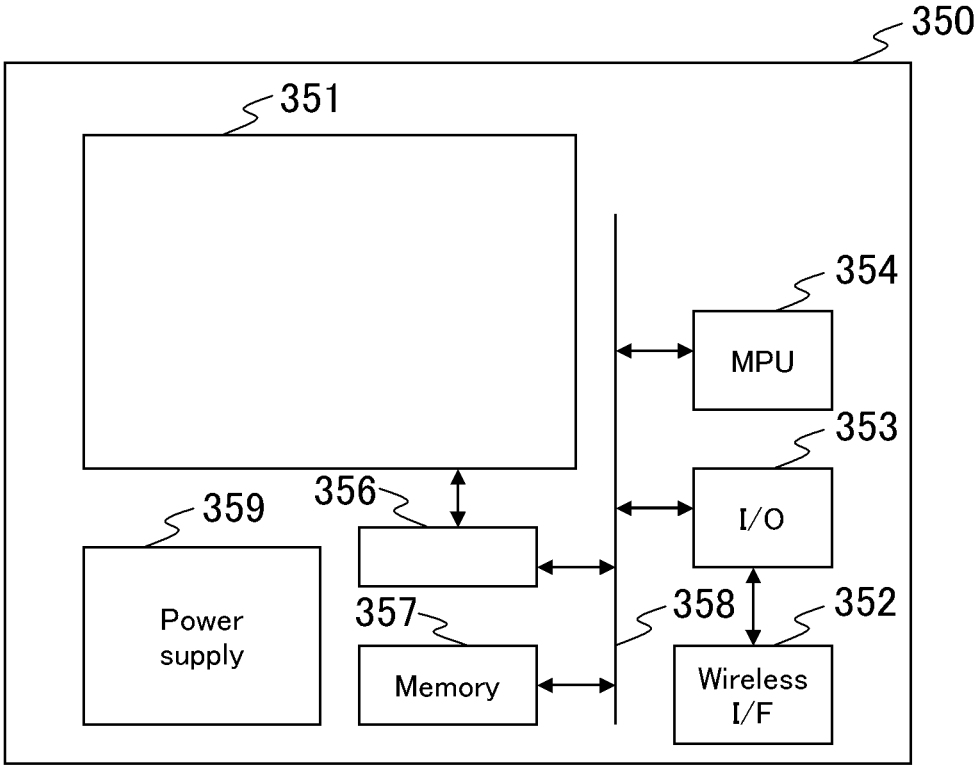
FIG. 31 is a system constitutional view of an internet image display device according to a twelfth embodiment of the present invention.

FIG. 31 is a constitutional view of an internet image display device 350 according to a twelfth embodiment. Compressed image data or the like is inputted to a wireless interface (I/F) circuit 352 from the outside as wireless data, and an output of the wireless I/F circuit 352 is connected to a data bus 358 through an I/O (Input/Output) circuit 353. Besides the wireless I/F circuit 352, a micro processor (MPU) 354, a display panel controller 356, a frame memory 357 and the like are connected to the data bus 358. Further, an output of the display panel controller 356 is inputted to an image display device 351 which uses optical shutters. The internet image display device 350 is further provided with a power source 359. Here, the image display device 351 provided with the optical shutters has the same constitution and the same manner of operation as the display panel of the first embodiment described previously and hence, the description of the internal constitution and the manner of operation of the image display device 351 is omitted.

Next, the manner of operation of the image display device 351 according to the twelfth embodiment is explained. First, the wireless I/F circuit 352 fetches compressed image data from the outside in response to a command, and transfers the image data to the microprocessor 354 and the frame memory 357 through the I/O circuit 353. Upon receiving a command operation from a user, the microprocessor 354 drives the whole internet image display device 350 when necessary thus performing decoding, signal processing or information display of the compressed image data. The image data subjected to signal processing can be temporarily stored in the frame memory 357.

When the microprocessor 354 outputs a display command, image data is inputted to the image display device 351 from the frame memory 357 through the display panel controller 356 in accordance with the instruction, and the image display device 351 displays the inputted image data in real time. At this point of time, the display panel controller 356 simultaneously performs an output control of a predetermined timing pulse necessary for displaying an image. The display of the inputted image data in real time by the image display device 351 using these signals is exactly as same as the display explained in conjunction with the first embodiment. A secondary cell is included in the power supply 359 in the definition thereof, and the secondary cell supplies electricity for driving the whole internet image display device 350.

According to this embodiment, it is possible to provide the internet image display device 350 which can perform a high image quality display and can reduce power consumption at a low cost.

Although the image display device 351 which has the substantially same constitution as the image display device 100 explained in conjunction with the first embodiment is used as the image display device in this embodiment, various kinds of display devices described in other embodiments of the present invention can be used besides the image display device 351.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A display device comprising:

a light source which emits lights having a plurality of different main wavelengths independently;

a light emission control part which allows the light source to continuously emit the light having one main wavelength of the plurality of different main wavelengths in each of a plurality of sub frames which are time widths in a period of 1 frame which is a display period for one screen;

a display panel which controls the transmission of light irradiated from the light source in each pixel; and a display control part which controls the display panel so as to transmit the light corresponding to a gray level value with respect to the each pixel of the display panel, wherein the light emitting control part performs the light emission of light having the first main wavelength in a first sub frame or performs the light emission of the light having the first main wavelength in a second sub frame in accordance with a light emission amount weighted based on a time for calculation including a first interval which is a interval between the first sub frame where the light having the first main wavelength which is one of the plurality of different main wavelengths is emitted and a second sub frame where the light having the first main wavelength is emitted subsequently after the first sub frame.

2. The display device according to claim 1, wherein the time for calculation further includes a second interval which is a interval between the first sub frame and a third sub frame which is arranged immediately before the first sub frame and in which the light having the first main wavelength is emitted.

3. The display device according to claim 1, wherein the interval is a time interval which falls within a range from a time interval of a non-light emission period between the neighboring sub frames where the lights having the same main wavelength are emitted to a time interval between light emission centers of the neighboring sub frames.

4. The display device according to claim 1, wherein the interval is a time interval between the light emission centers of neighboring sub frames where the lights having the same main wavelength are emitted.

5. The display device according to claim 1, wherein the interval is a time interval of a non-light emission period between the neighboring sub frames where the lights having the same main wavelength are emitted.

6. The display device according to claim 1, wherein the weighted light emission amount is brightness, and the light emission control part performs the weighting such that the light emission amount is proportional to a magnitude of the time for calculation without changing a total light emission amount over predetermined number of frames.

7. The display device according to claim 1, wherein the 1 frame is constituted of three sub frames of three colors of R (red), G (green) and B (blue).

8. The display device according to claim 1, wherein the 1 frame is constituted of four sub frames in total consisting of three sub frames of three colors of R (red), G (green) and B (blue) and any one of the three sub frames of three colors of R (red), G (green) and B (blue).

9. The display device according to claim 1, wherein the 1 frame is constituted of six sub frames.

10. The display device according to claim 1, wherein in the 1 frame, the placement of the sub frame where the light having a main wavelength in a range of green is fixed.

11. The display device according to claim 10, wherein the light emission brightness in the sub frame where the light having a main wavelength in the range of green changes cyclically.

12. The display device according to claim 1, wherein one placement of the sub frames in the 1 frame is in normal order or in reverse order of R (red), G (green), R (red), B (blue), G (green) and R (red) and another placement of the sub frames in the 1 frame is in normal order or in reverse order of B (blue), G (green), B (blue), R (red), G (green) and B (blue), and, the one placement and the another placement are alternately repeated.

13. The display device according to claim 1, wherein one placement of the sub frames in the 1 frame is in normal order or in reverse order of R (red), G (green), R (red), B (blue), G (green) and R (red) and another placement of the sub frames in the 1 frame is in normal order or in reverse order of B (blue), G (green), R (red), B (blue), G (green) and B (blue), and, the one placement and the another placement are alternately repeated.

14. The display device according to claim 1, wherein the display panel performs light emission corresponding to a gray level value by controlling a time of light transmission.

15. The display device according to claim 1, wherein the display panel uses an MEMS (Micro-Electro-Mechanical System) shutter which performs light emission corresponding to a gray level value by controlling a time of light transmission.

16. The display device according to claim 1, wherein the display panel uses a DMD (Digital Mirror Device) shutter which performs light emission corresponding to a gray level value by controlling a time of light transmission.

17. The display device according to claim 1, wherein the display panel uses a liquid crystal shutter which allows the transmission of light corresponding to a gray level value by performing a control of brightness of a transmitting light.

18. The display device according to claim 1, wherein the light source is formed of a Light Emitting Diode (LED), and the light emission brightness is controlled by turning on or off the LED.

* * * * *